US008192296B2

(12) United States Patent
Pinkart

(10) Patent No.: US 8,192,296 B2
(45) **Date of Patent: *Jun. 5, 2012**

(54) GRIPPING SYSTEM, APPARATUS, AND METHODS

(76) Inventor: Patrick Pinkart, Los Osos, CA (US)

( * ) Notice: Subject to any disclaimer, the term of this patent is extended or adjusted under 35 U.S.C. 154(b) by 308 days.

This patent is subject to a terminal disclaimer.

(21) Appl. No.: 12/571,097

(22) Filed: Sep. 30, 2009

(65) Prior Publication Data

US 2010/0011483 A1 Jan. 21, 2010

Related U.S. Application Data

(63) Continuation-in-part of application No. 12/433,817, filed on Apr. 30, 2009, now abandoned, which is a continuation of application No. 11/352,117, filed on Feb. 9, 2006, now Pat. No. 7,530,898.

(51) Int. Cl.
*A63B 53/14* (2006.01)

(52) U.S. Cl. ..... 473/205; 473/201; 473/300; 473/301; 473/302

(58) Field of Classification Search ..... 473/201, 473/203, 205, 206, 212, 300–303, 458, 464, 473/549, 551; 2/161.1, 161.2, 161.3
See application file for complete search history.

(56) References Cited

U.S. PATENT DOCUMENTS

| | | | |
|---|---|---|---|
| 3,028,283 | A | 4/1962 | Lundgren et al. |
| 3,368,811 | A | 2/1968 | Finney |
| 3,508,280 | A | 4/1970 | Osborn |
| 3,532,344 | A | 10/1970 | Masstab |
| 4,665,565 | A | 5/1987 | Odom |
| 4,691,387 | A | 9/1987 | Lopez |
| 5,232,225 | A | 8/1993 | Snyder |
| 5,742,942 | A | 4/1998 | Sykes |
| 5,984,795 | A | 11/1999 | Stafford |
| 6,732,377 | B1 | 5/2004 | Wilkinson |
| 7,211,004 | B2 | 5/2007 | DeMarco |
| 7,530,898 | B2 | 5/2009 | Pinkart |
| 2002/0147054 | A1 | 10/2002 | Wu et al. |
| 2003/0045370 | A1 | 3/2003 | Jaw |

(Continued)

FOREIGN PATENT DOCUMENTS

| | | |
|---|---|---|
| CA | 1232403 | 2/1988 |
| GB | 2313320 | 11/1997 |

OTHER PUBLICATIONS

Examiner Interview Summary from U.S. Appl. No. 12/433,817 mailed Jun. 21, 2010.

(Continued)

*Primary Examiner* — Raleigh W. Chiu
(74) *Attorney, Agent, or Firm* — Fitch, Even, Tabin & Flannery, LLP

(57) ABSTRACT

A gripping system, apparatus, and methods for users with weakened hand strength, or able-bodied users desiring a better grip, involving a mating glove and a grip, handle, or graspable surface of an object. The mating glove covers a person's hand and interfaces and mates with the grip, handle, or graspable surface. The mating glove has a palm side, a dorsal side, and finger compartments. The mating glove includes hook-and-loop fastener material for mating with complementary hook-and-loop fastener material integrated into the grip, handle, or graspable surface. The grip, handle, or graspable surface further includes recesses integrated within the grip or handle for accommodating the hook-and-loop fastener material. The invention also involves a retrofit tape kit for facilitating gripping of any graspable surface.

27 Claims, 22 Drawing Sheets

U.S. PATENT DOCUMENTS

| | | | |
|---|---|---|---|
| 2004/0132538 | A1 | 7/2004 | Oury et al. |
| 2004/0142756 | A1 | 7/2004 | Oury |
| 2005/0268372 | A1 | 12/2005 | DeMarco |

OTHER PUBLICATIONS

Non-Final Office Action from U.S. Appl. No. 12/433,817 mailed Feb. 18, 2010.

Pinkart, Patrick, U.S. Appl. No. 12/433,817, filed Apr. 30, 2009.

Notice of Allowance for U.S. Appl. No. 11/352,117 mailed Dec. 31, 2008.

Final Rejection from U.S. Appl. No. 11/352,117 mailed May 1, 2008.

Non-final office action from U.S. Appl. No. 11/352,117 mailed Jun. 6, 2007.

GRIPPING SYSTEM, APPARATUS, AND METHODS

CROSS-REFERENCE TO RELATED APPLICATION(S)

This document is a continuation-in-part application that is related to, and claims priority through U.S. patent application Ser. No. 12/433,817, entitled "Mating Golf Glove with Club Grip Methods," and filed on Apr. 30, 2009, that is, in turn, related to, and claims priority from, U.S. patent application Ser. No. 11/352,117, also entitled "Mating Golf Glove with Club Grip Methods," and filed on Feb. 9, 2006, all of which are commonly owned, and which are hereby incorporated by this reference in their entirety.

TECHNICAL FIELD

The present invention technically relates to systems, apparatuses, and methods for assisting persons having weakened hand-strength with the grasp and retention of an object or able-bodied persons having a need for improving or securing the grasp and retention of an object. More particularly, the present invention technically relates to systems, apparatuses, and methods for assisting persons having weakened hand-strength with the grasp and retention of a graspable surface for any given object or able-bodied persons having a need for improving or securing the grasp and retention of a graspable surface for any given object.

BACKGROUND ART

In the related art, for example, the activity of golfing requires a certain amount of gripping force with the club to allow swinging action and impact with a golf ball. Users who experience a weakened grip due to complications with arthritis, carpal tunnel syndrome, accretions of hand and wrist injuries, congenital defects, nerve injury, and normal aging processes lack the sufficient gripping power needed to ensure golf club stability, control, and alignment during swing and impact with the golf ball. For those people who are afflicted with a weakened grip, they may find golf virtually impossible to play. Users with weakened hand strength, or users who have not been taught a fundamentally sound or technically-correct grip configuration, will often have difficulty squaring the clubface at impact with the golf ball which can lead to twisting of the golf club and club face, thereby producing an inaccurate shot, whereby inaccurate shots veer from the intended trajectory. Furthermore, as a user's hands, even those of an able-bodied person, fatigue during a round of golf, play becomes even more difficult and the club may completely slip out of the hands and become airborne creating a serious hazard to people standing nearby.

The golfing and sporting industries have not adequately addressed the problems encountered by those with weakened hand strength. Furthermore, these industries have not provided effective grip training aids for teaching users a technically-correct gripping configuration. Although there are many schools of thought regarding the correct grip of the gripping portion of the golf club shaft, golf instruction schools predominately teach two styles of gripping configuration. In the Vardon grip, the little finger of the trailing hand (the hand disposed lower on the club, e.g., the right hand for a right-handed player) is placed between the index and middle finger on the lead hand (the hand disposed higher on the club). The lead-hand thumb should fit in the "lifeline" of the trailing hand. The second technique teaches that the grip should be located in the palm of the hands, thereby avoiding interlocking between the fingers. This second style is referred to as the "Natural Grip."

Some other attempts have been made to solve these problems in the related art; however, these approaches are cumbersome. Some users have resorted to the use of pine tar which only lasts a short time, thereby requiring frequent re-application which tends to transfer pine tar to the clothing, the golf ball, and the equipment, thereby further hindering the player's game. Some grip manufacturers have integrated enlarged golf grips or raised ridges or dots on the grip surface. However, these changes do not sufficiently solve the aforementioned problems in the related art.

Unfortunately, the related art inventions have not solved these issues. U.S. Pat. No. 5,742,942 does attempt to enable a person to attain a better grasp of the golf club; however, this product is cumbersome to use. The strap mechanism is difficult and awkward to fasten around a person's hand(s). If a user is experiencing bilateral weakness, thereby requiring both hands to be strapped, third party assistance is required. In addition, this product may be embarrassing for some users to use in the company of friends, family, or strangers due to its appearance and laborious application.

In addition to the foregoing problems faced by those having weakened hand strength in relation to sporting goods, such problems extend to grasping of many other physical objects. Therefore, a long-felt need exists for a system, apparatus, and method that enable persons, having a weakened grip, or able-bodied persons, desiring a more secure grip, to grasp an object with an appropriate force so as to stabilize the object and to avoid dropping the object inadvertently.

SUMMARY OF THE INVENTION

The present invention system, apparatus, and methods generally involve a combination, comprising a glove member and either a grip member or a handle member, the combination being adaptable to any graspable surface, e.g., sporting goods, exercise equipment, physical therapy equipment, hardware tools, kitchen tools, kitchen utensils, cooking apparatuses, biomedical devices, walking-assistance apparatuses, gardening tools, and any other object having a graspable surface. The present invention provides a solution to the related art problems and many other advantages that enable a user, who may be handicapped by a weakened hand, insufficient hand-grip strength, or amputation, e.g., a partial hand amputation, a partial or full finger amputation, or other such amputation, to perform almost any given activity. Also, during inclement weather, a user, even an able-bodied user, may experience excessive perspiration, thereby resulting in environmentally compromised hand-grip strength, and thereby resulting in slippage of a graspable object.

In addition, the present invention imparts a feel that is nearly identical with that of merely wearing gloves. The glove member in the present invention may comprise a fingered glove, a fingerless glove, a mitten, and the like. The glove member may also comprise an adaptive cuff, e.g., disposed around the hand, the adaptive cuff facilitating grasping of objects. The present invention may also be used by able-bodied persons desiring a more secure grip on an object, e.g., a motion picture "grip" may wish to better secure a "boom" in his hands while filming or a "roofer" desiring to better grasp a hammer while working on a roof. Further, the gripping portion or handling portion of a graspable surface, having the present invention features, is not readily perceivable by others, especially when in use. Also, the present invention involves a retrofit-tape apparatus, comprising a retrofit-tape, being adaptable to any graspable surface of any object. The retrofit-tape apparatus further comprises end-stops for retaining the retrofit tape as well as the user's hand(s) in a desired position.

An advantage of the present invention is that it is especially suited for users, having weakened hand strength, insufficient hand-grip strength, or amputation, to attain and maintain a grip with sufficient strength to control an object, such as a shaft, and to limit its twisting or turning in any unintended positions. Users having an amputation, e.g., an amputated thumb, an amputated finger, an amputated hand, or an amputated arm, may benefit from the present invention, especially where a two-handed grip would otherwise be required for a given sport or activity. Able-bodied users can achieve a more secure grip on an object using the present invention. In essence, the present invention assists the user in preventing unintentional movement of the object to be grasped. A further advantage of the present invention is that it teaches or trains users in making a technically correct, logical, or ergonomic grip for any given object, especially in the area of sporting goods. This is achieved by placing various patterns of hook material or loop material on the glove in order to accommodate a specific desired grip for any given object.

BRIEF DESCRIPTION OF THE DRAWINGS

For a better understanding of the present invention, reference is made to the below-referenced accompanying Drawing(s). Reference numbers refer to the same or equivalent parts of the present invention throughout the several figures of the Drawing(s).

MODE(S) FOR CARRYING-OUT THE INVENTION

According to a preferred embodiment of the present invention, a glove-and-grip system, apparatus, and methods, are used to enable people with weakened hand strength, or able-bodied people desiring a better grip, to sufficiently grasp and secure an object, especially an object having a grip, a shaft, or a handle. The present invention is also used to teach or train a user the correct technique for gripping a given object. The present invention imparts a "feel" that is nearly identical to that of merely wearing a glove. The present invention configures a glove in a manner such that the hand, upon which it is to be worn, can attain a forceful, grasping, and linking relationship with the object upon contact thereof, e.g., during the address and swing of a golf club or a tennis racquet in the area of sporting goods.

Figure 1:
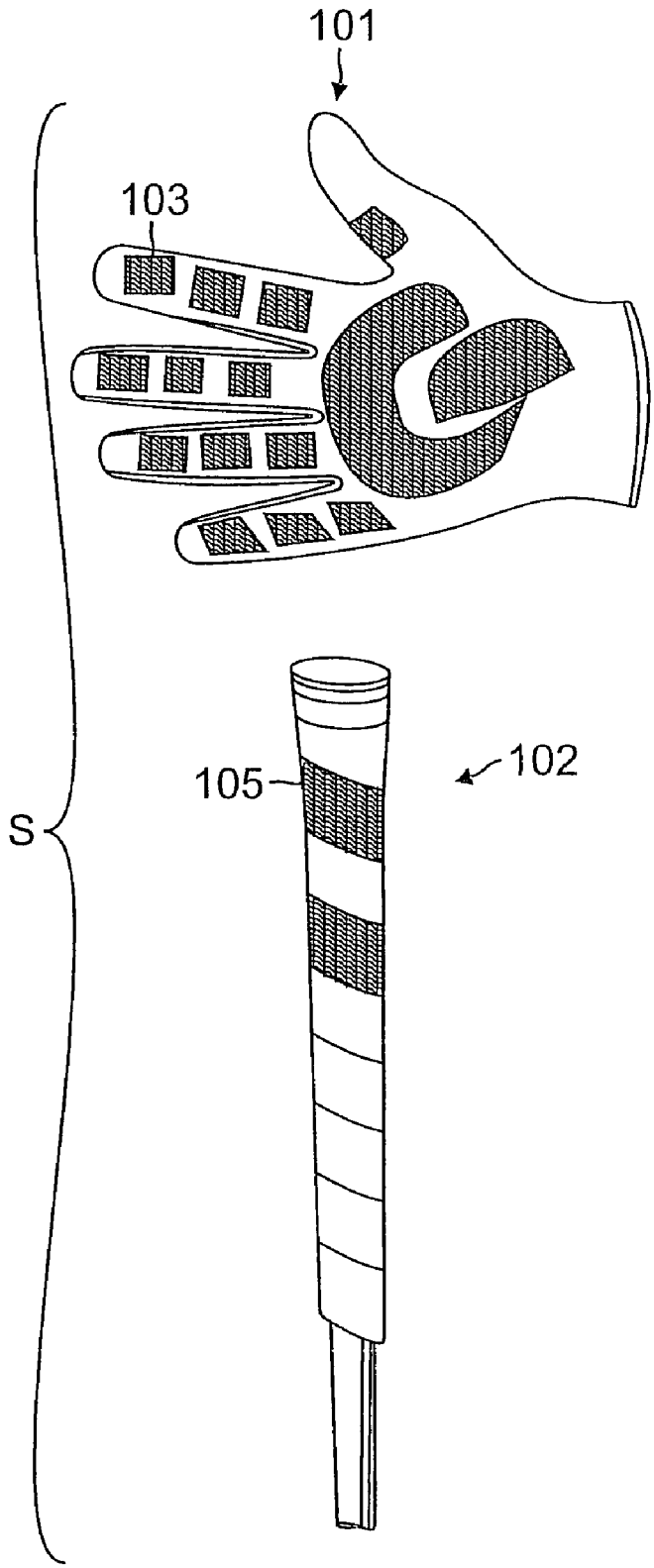
FIG. 1 is a perspective view of a glove-and-grip system in relation to an object comprising a shaft, by example only, according to an embodiment of the present invention.

FIG. 1 illustrates a preferred embodiment of the glove-and-grip system S, in accordance with the present invention. The system S includes at least one glove, such as a golf glove 101, and at least one graspable surface, such as a club grip 102, by example only. Both the golf glove 101 and the club grip 102 are adapted to securely mate with each other. The golf glove 101 comprises a gripping feature. The golf glove 101 has a palm side, a dorsal side, and a plurality of finger compartments. The palm side comprises a planar surface which interfaces with the palm of a user. The dorsal side comprises a back surface of the golf glove 101 which interfaces with the back side of a user's hand. The plurality of finger compartments accommodates the user's fingers. The golf glove 101 may comprise any suitable material.

The gripping feature of the golf glove 101 comprises a fastener, such as a hook-and-hoop material, e.g., Velcro®, disposed on the palm side of the golf glove 101. In some preferred embodiments where the golf glove 101 comprises loop material, the loop material will mate with the corresponding hook material of the grip 102. In preferred embodiments, wherein the golf glove 101 alternatively comprises the hook material, the hook material will mate with the corresponding loop material of the club grip 102.

Figure 2A:
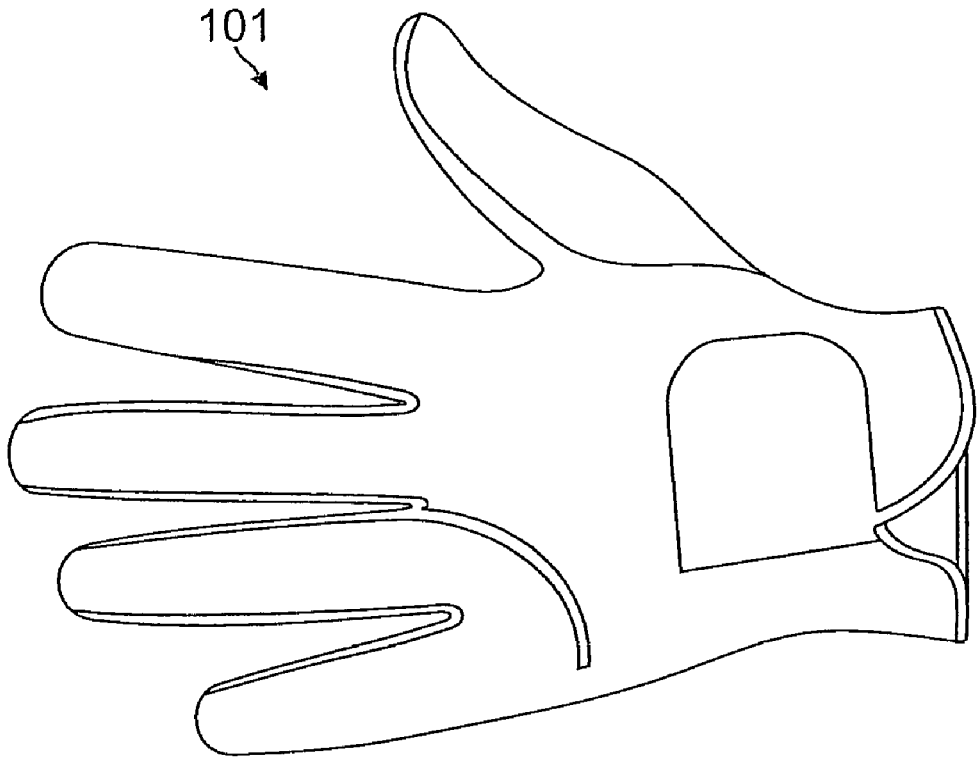
FIG. 2*a* is a top view of a glove, according to a preferred embodiment of the present invention.
Figure 2B:
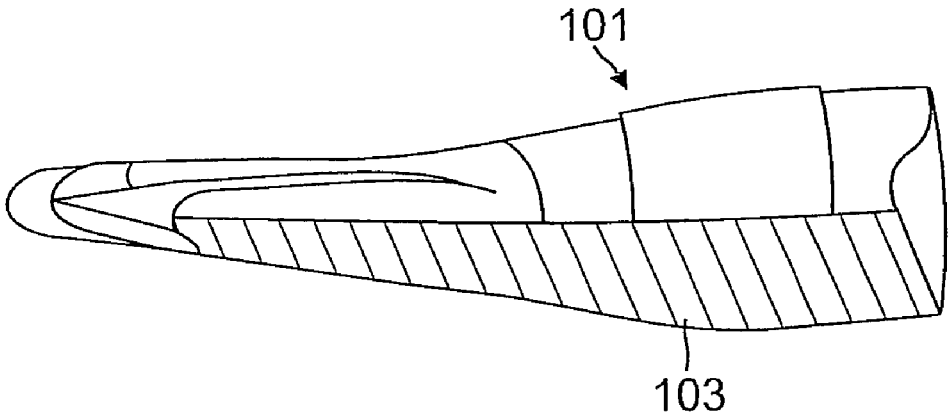
FIG. 2*b* is a side view of a glove, according to a preferred embodiment of the present invention.
Figure 2C:
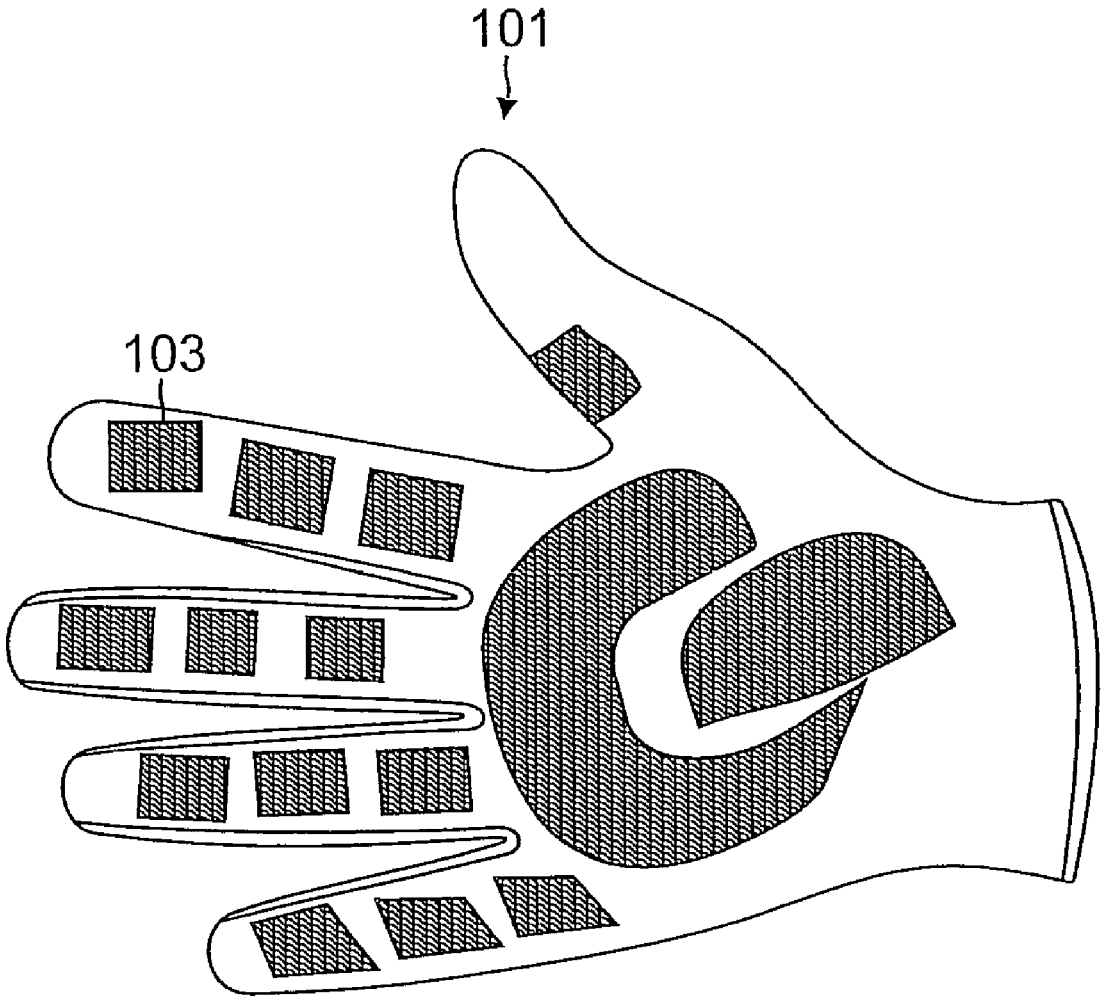
FIG. 2*c* is a bottom view of a glove, according as a preferred embodiment of the present invention.

FIGS. 2*a-c* further illustrate the golf glove 101. The golf glove 101 comprises the loop material 103, e.g., being sewn thereto. Since the interface is disposed between the palm side of the golf glove 101 with the club grip 102, the only side of the golf glove 101 which will have the loop material or the hook material is the palm side. The fasteners, e.g., loop material or the hook material may be affixed to the golf glove by a technique, such as sewing or adhering; and such fasteners may be used to retrofit the golf glove 101.

Figure 3A:
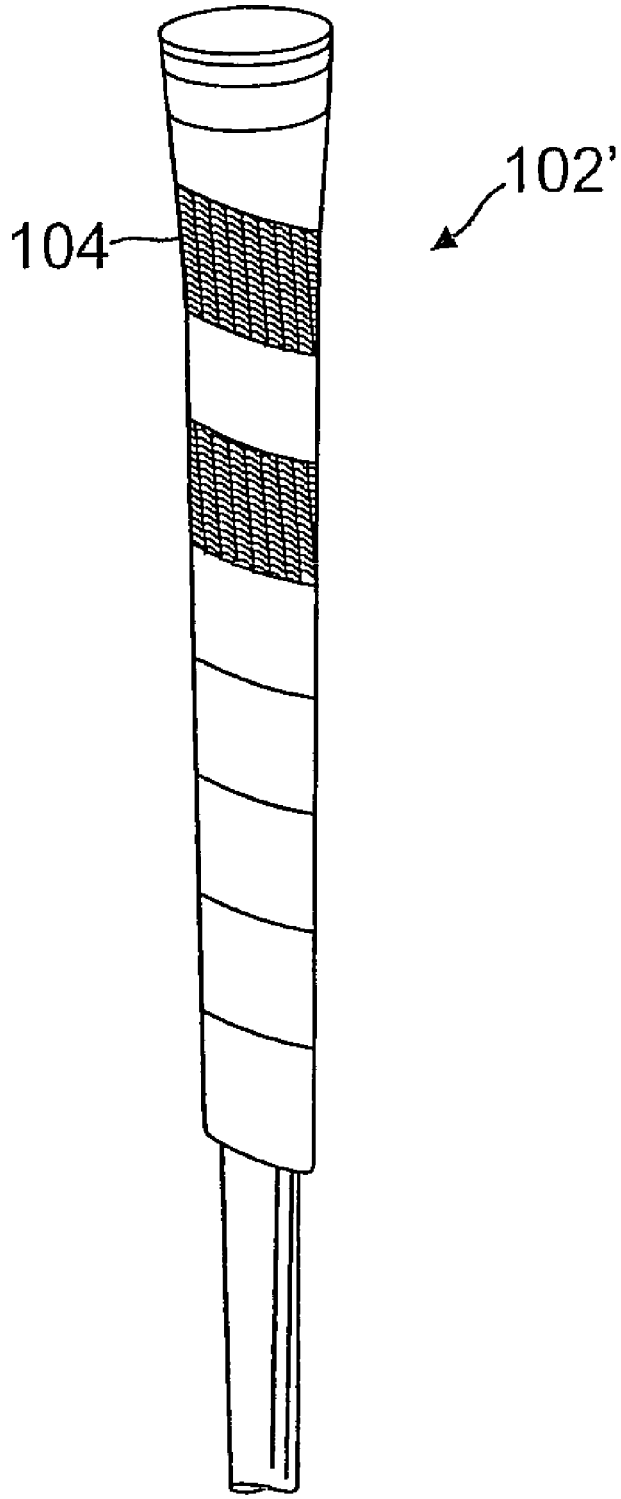
FIG. 3*a* is a perspective view of a grip in relation to an object comprising a shaft, by example only, according to an embodiment of the present invention.
Figure 3B:
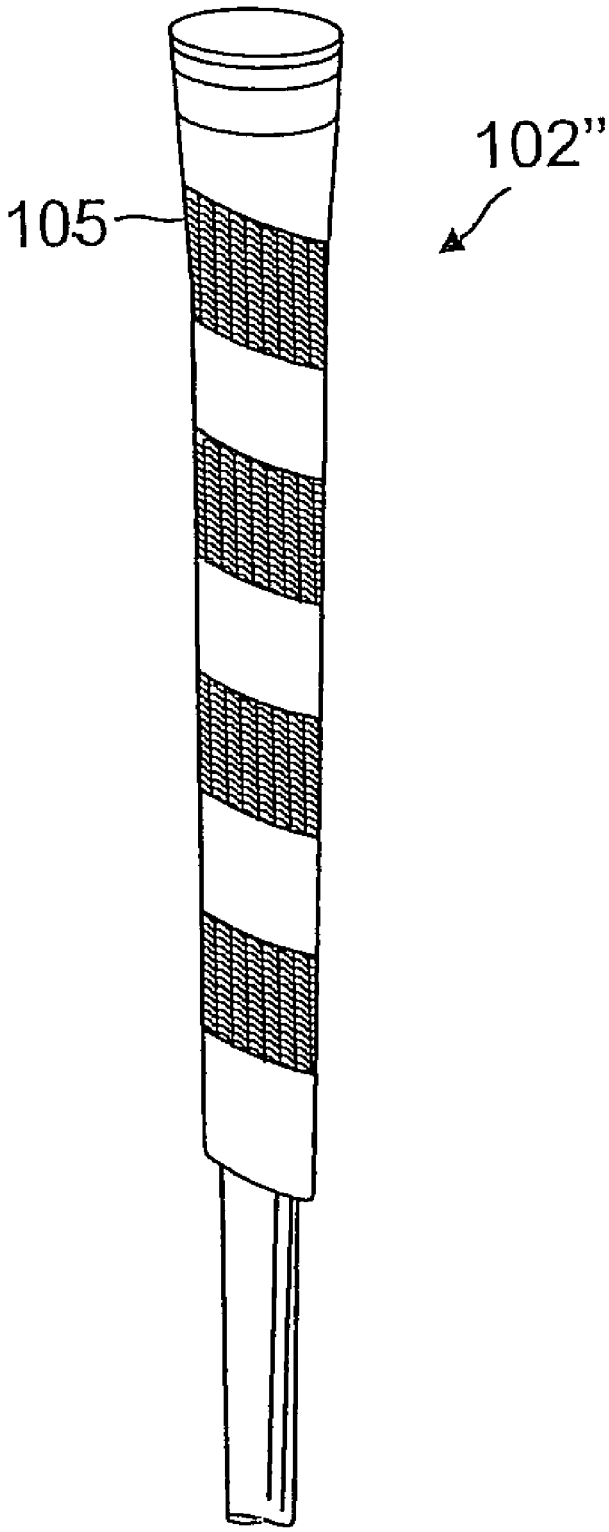
FIG. 3*b* is a perspective view of a grip in relation to an object comprising a shaft, by example only, according to an alternate embodiment of the present invention.
Figure 3C:
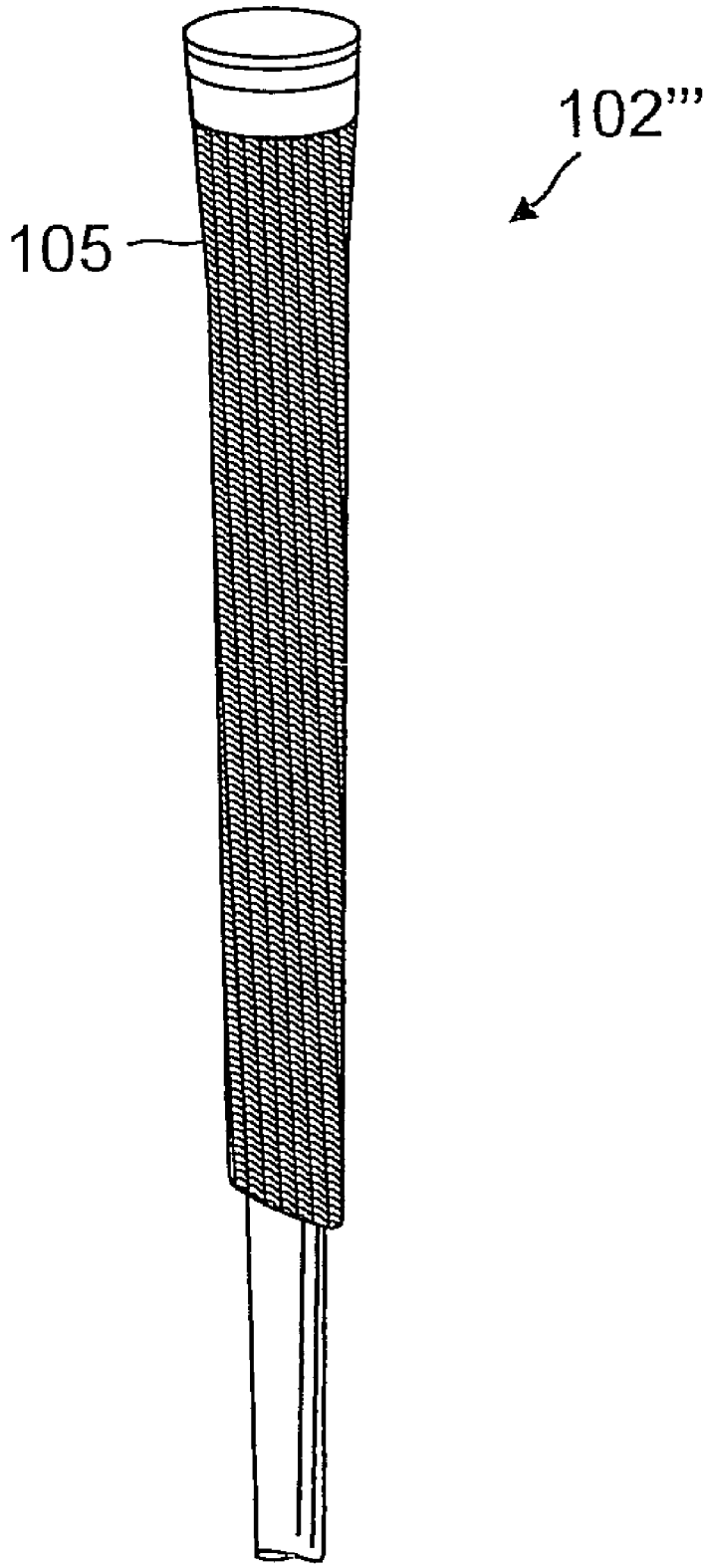
FIG. 3*c* is a perspective view of a grip in relation to an object comprising a shaft, by example only, according to another embodiment of the present invention.

FIGS. 3*a-c* illustrate alternate preferred embodiments of the club grips 102', 102", and 102'" in relation to golf. Golf club grips abound in many different styles and comprise a panoply of materials. Materials, such as polymers, e.g., ethylene propylene diene monomer (epdm), leather, e.g., cowhide, calfskin, mammal, amphibious, reptile, and any other animal skins, rubber (natural or synthetic), cotton, various types of cord (such as "classic", "GX", or "tour wrap"), or granulated cork are all adaptable for use with the present invention. For this reason, the materials used for fabricating the club grips 102', 102", 102'" may comprise any suitable material. Moreover, other characteristics or components of a grip which may be integrated such as small holes, grooves, or ridges may also be incorporated with the present invention. However, small holes, grooves, or ridges are strictly optional for use with the present invention.

The club grips 102, 102', 102", 102'", in some preferred embodiments, are specially engineered, die-cast molded rubber golf club grips having integrated hook material 104 (or loop material in some preferred embodiments) around the club grips 102, 102', 102", 102'". In the illustrated preferred embodiment, recesses are used to accommodate the hook material or the loop material for flush disposition with the surface of the club grip 102, 102', 102", 102'". The purpose of the recesses is to obscure the view of the hook material or the loop material on the club grips 102, 102', 102", 102'". The primary reason for obscuring the view of the hook material or the loop material is to alleviate any insecurity or conflicting emotions of a user when playing or practicing with other users. Another reason is that the recesses may be more comfortable to the touch for some users. The use of recesses is preferred, but not specifically required by the present invention. In other words, some embodiments may incorporate the recesses; and other embodiments may not.

Turning now to FIGS. 3*a-c* in the first embodiment, only the top portion of the club grips 102, 102', 102", 102'" incorporate the hook material 104. Since most users only use one glove for the hand on the upper portion of the club grip 102, 102", the embodiment illustrated in FIG. 3*a* will probably be the embodiment most often used.

Figure 5:
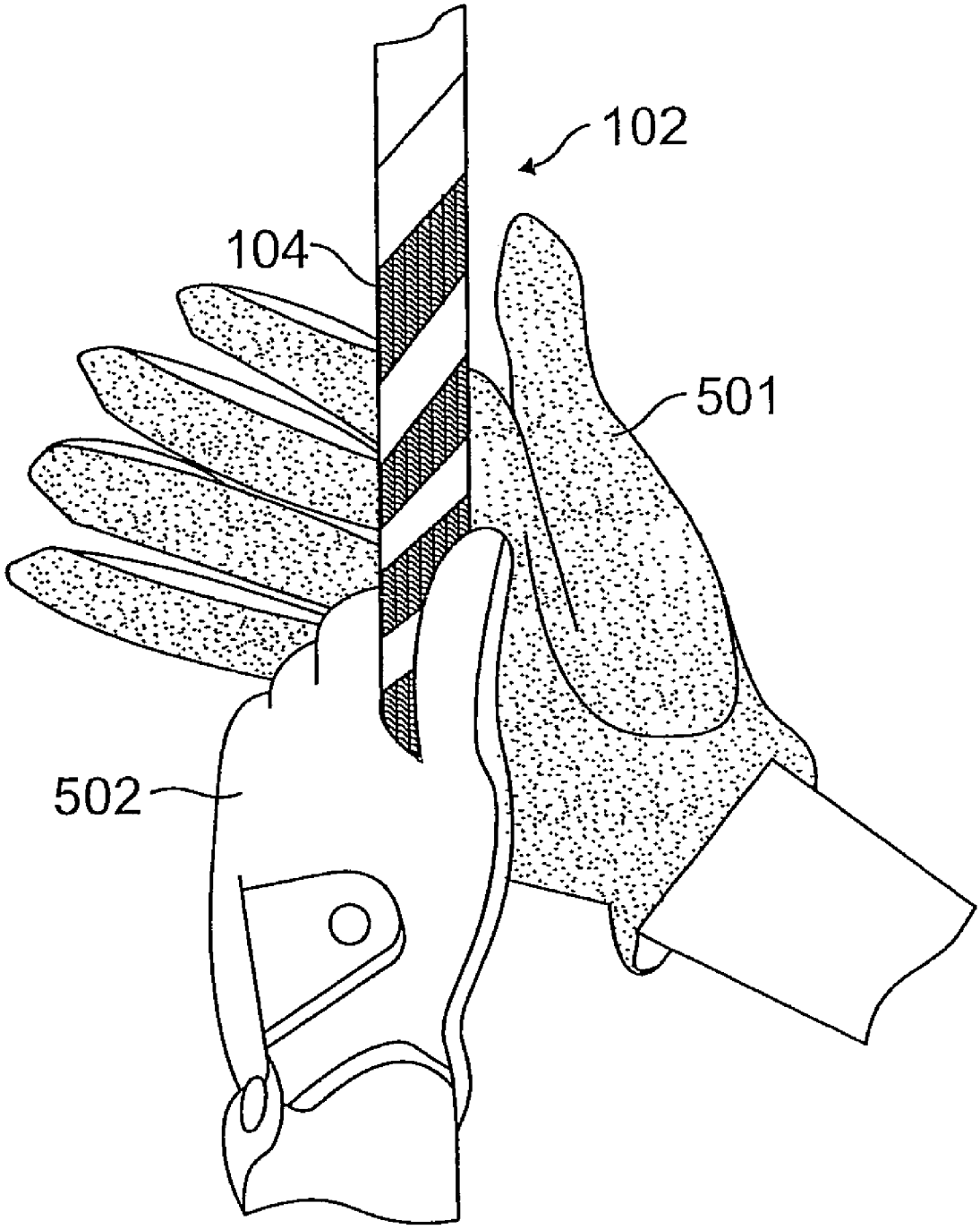
FIG. 5 is a perspective view of a glove-and-grip system in relation to an object comprising a shaft, by example only, during use, according to a preferred embodiment of the present invention.

FIGS. 3*b* and 5 illustrate an alternative preferred embodiment of the club grip 102" of the present invention. In this bilateral embodiment, two gloves 501, 502 are used. Although this is unorthodox for most users, it may help those users with weakened hand strength. Since this bilateral embodiment is meant to be used with gloves 501, 502 on both hands, the club grip 102" integrates the hook material 104 (and the loop material in some preferred embodiments) in alternate spiraling rows down the entire length of the club grip 102".

FIG. 3*c* illustrates another preferred bilateral embodiment of the club grip 102'". In this bilateral embodiment both gloves 501, 502 are used. Unlike club grip 102", club grip 102'" integrates the hook material 104 throughout the entire surface area of the club grip 102'".

Figure 4:
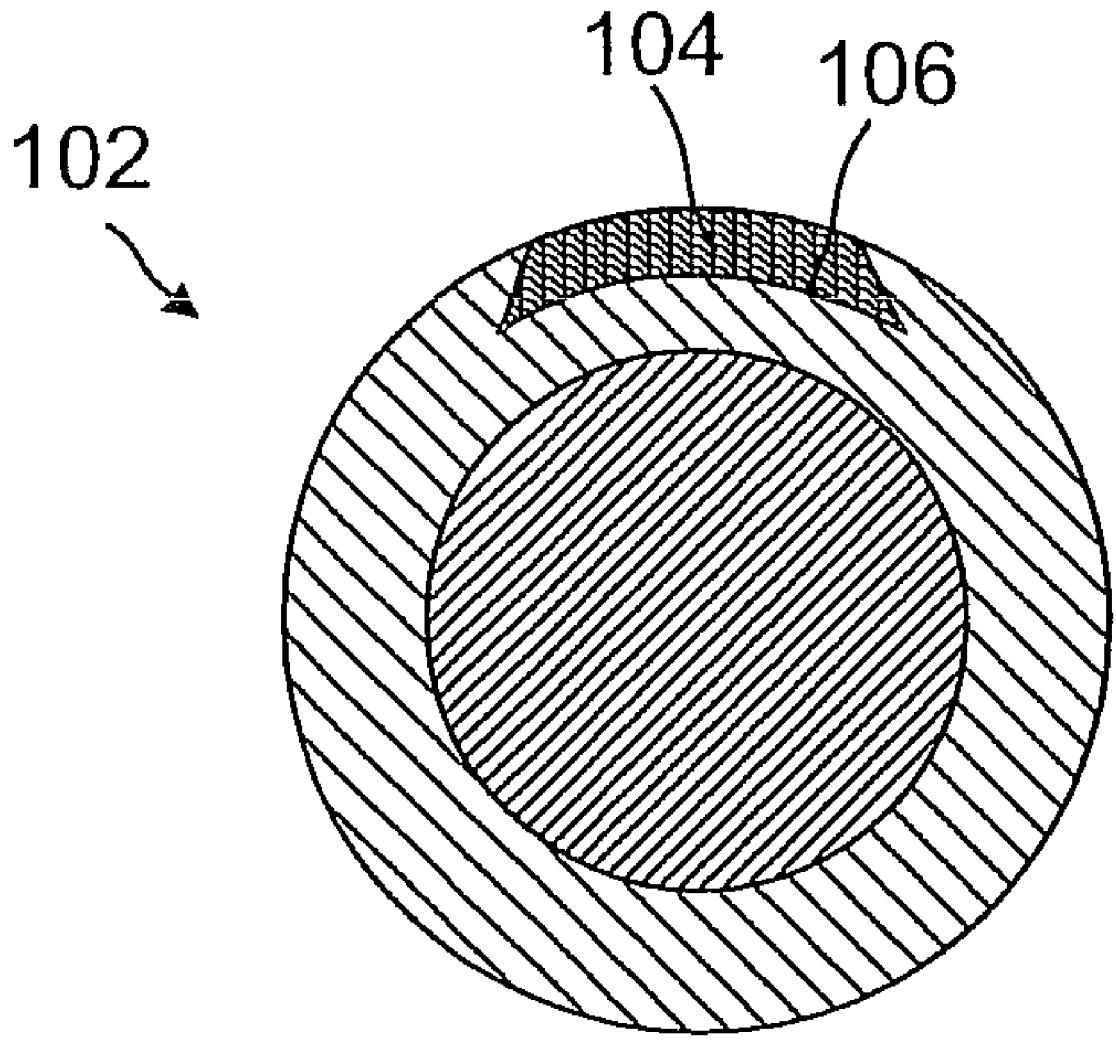
FIG. 4 is a cross-sectional view of a grip in relation to an object comprising a shaft, by example only, according to an embodiment of the present invention.

FIG. 4 illustrates a cross sectional view of a club grip 102. In preferred embodiments where the club grip 102 is recessed, the club grip 102 is recessed in such a way such that the hook material (or the loop material in some preferred embodiments) is flush with the grip surface. The hooks or loops material are embedded within the recess 106. This method of integrating the hook material (or loop material in some preferred embodiments) is preferable, because it is less noticeable to the naked eye. This recessed design is also more comfortable to the touch. The hook material may comprise three grades of hook material, such as a soft hook material, a standard hook material, and a molded hook material, the grades providing different degrees of fastenability.

Figure 6:
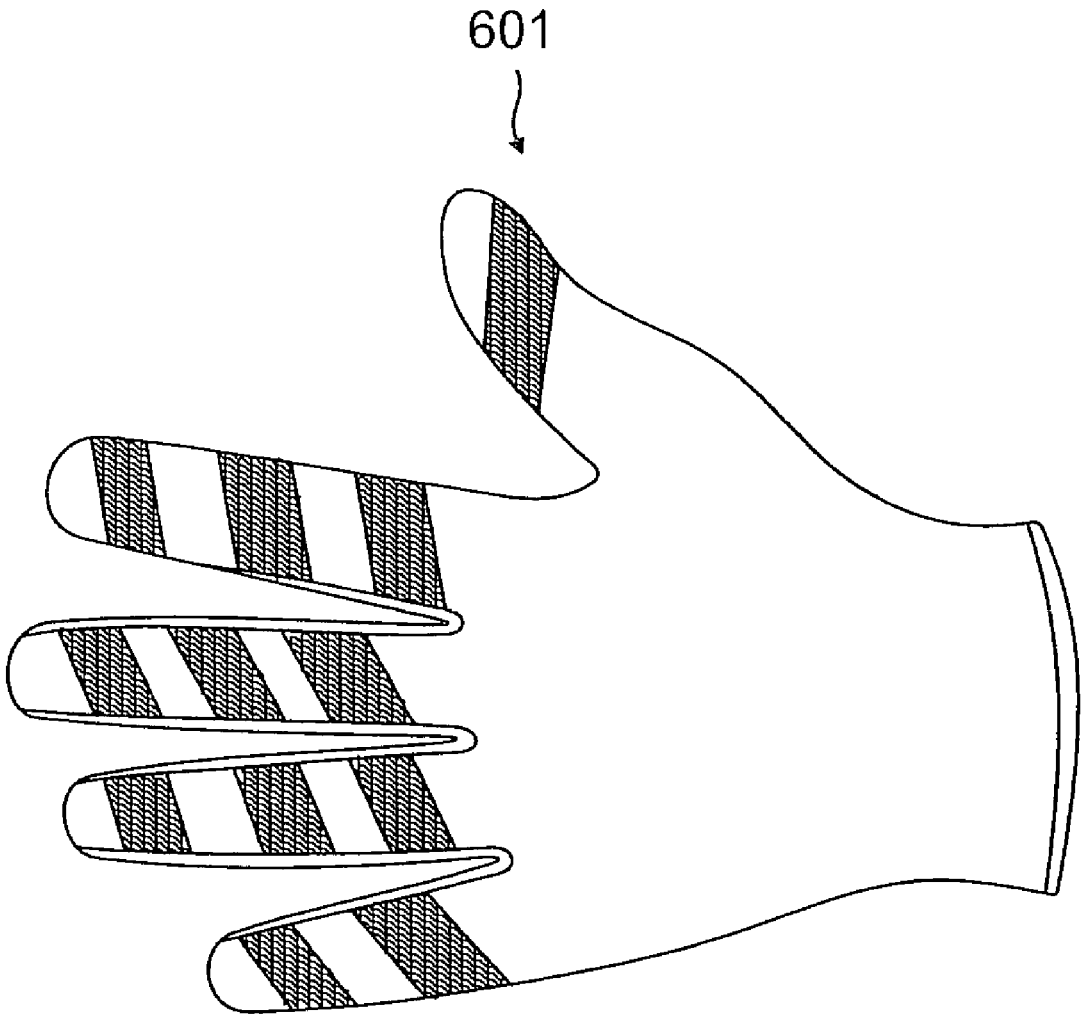
FIG. 6 is a bottom view of a glove, according to an embodiment of the present invention.
Figure 7:
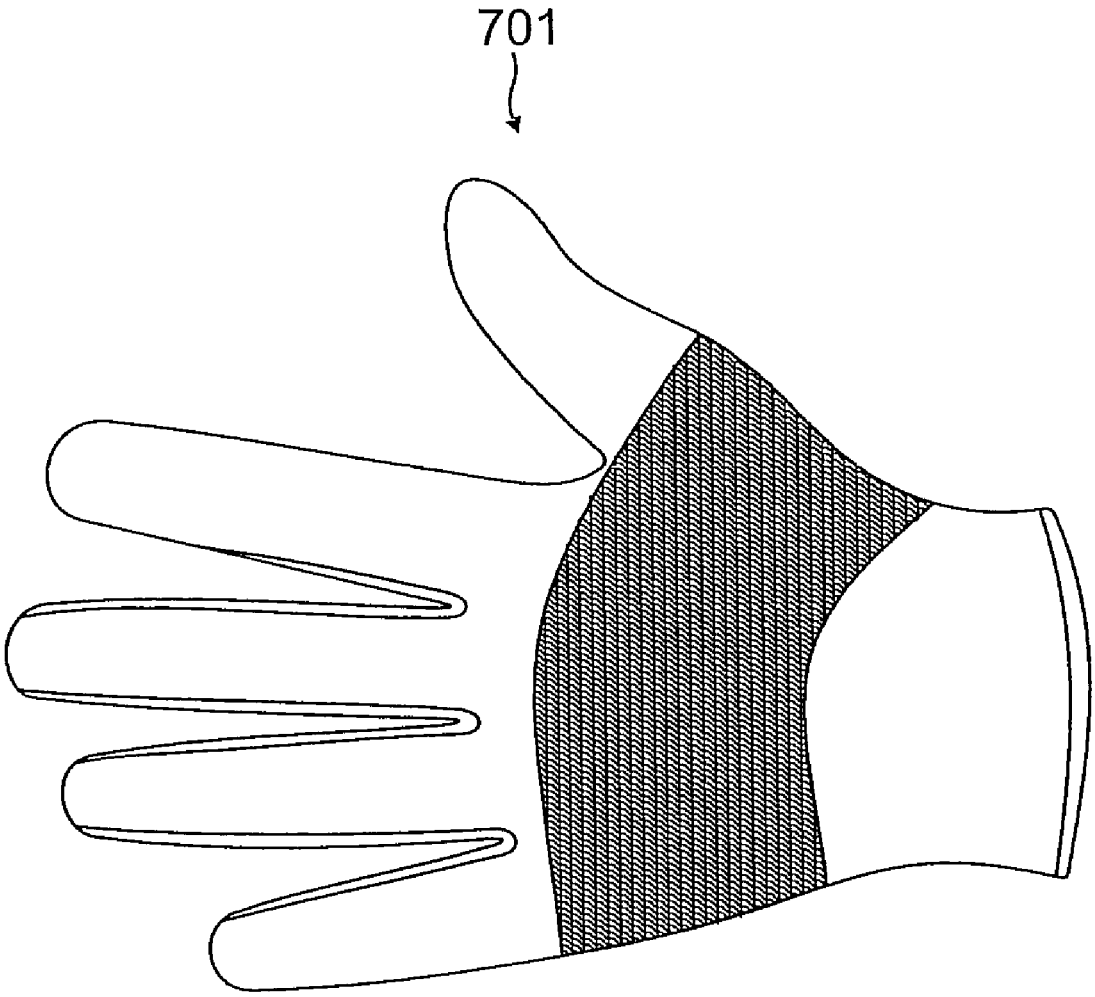
FIG. 7 is a perspective view of a glove, according to another embodiment of the present invention.

Referring to FIGS. 6 and 7, for example, since many athletics instructors, e.g., coaches and trainers, may beg to differ as to the proper methods of gripping a sporting good, various patterns of fasteners, e.g., loop material or hook material, may be used in order to facilitate these different types of grips. Perhaps the most popular type of grip is the "Vardon"-style grip in the activity of golf. The Vardon-style grip places a club grip in the fingers of a user rather than the palm. When using a Vardon-style grip, the user may employ the golf glove 601 of the embodiment illustrated in FIG. 6. Alternatively, if a user prefers a "Natural" grip, the user may place the club grip in the palms with a "10-finger grip." This golf glove 701 of the embodiment illustrated in FIG. 7 is shown. Other types of grips, e.g., golf grips, whether they use interlocking fingers, etc., may be taught using accommodating patterns of loop material or hook material affixed to the golf glove 101. For this reason, a panoply of different embodiments for the golf glove 101 are encompassed by the present invention.

Referring to FIGS. 8-13, the present invention encompasses many other embodiments, including a glove-and-grip system, apparatus, and methods, as applied to the following goods, by example only: sporting goods, e.g., tennis racquets, racquetball racquets, squash racquets, Jai alai "cestas," fencing weapons, miniature golf clubs, croquet mallets, cricket bats, softball bats, baseball bats, and the like; exercise equipment, e.g., barbells, gymnasium equipment handles; physical therapy equipment; hardware tools, e.g., hammers, screwdrivers, saws, and the like; power tools, e.g., power drills, electric screwdrivers, and the like; kitchen tools, e.g., knives, spatulas, and the like; kitchen utensils, e.g., flatware, and the like; cooking apparatuses, e.g., pots, pans, and the like; biomedical devices, e.g., prosthetics, disability tools, and the like; walking-assistance apparatuses, e.g., canes, walking sticks, walkers, and the like; recreational goods, e.g., hiking poles, wind-sailing grips, hang-gliding grips, kayak paddles, canoe paddles, fishing poles, fishing net poles, ski poles, and the like; gardening tools, e.g., hand-rakes and the like; toothbrushes, e.g., manual toothbrushes, electric toothbrushes, and the like; and any other object having a graspable surface.

Figure 8:
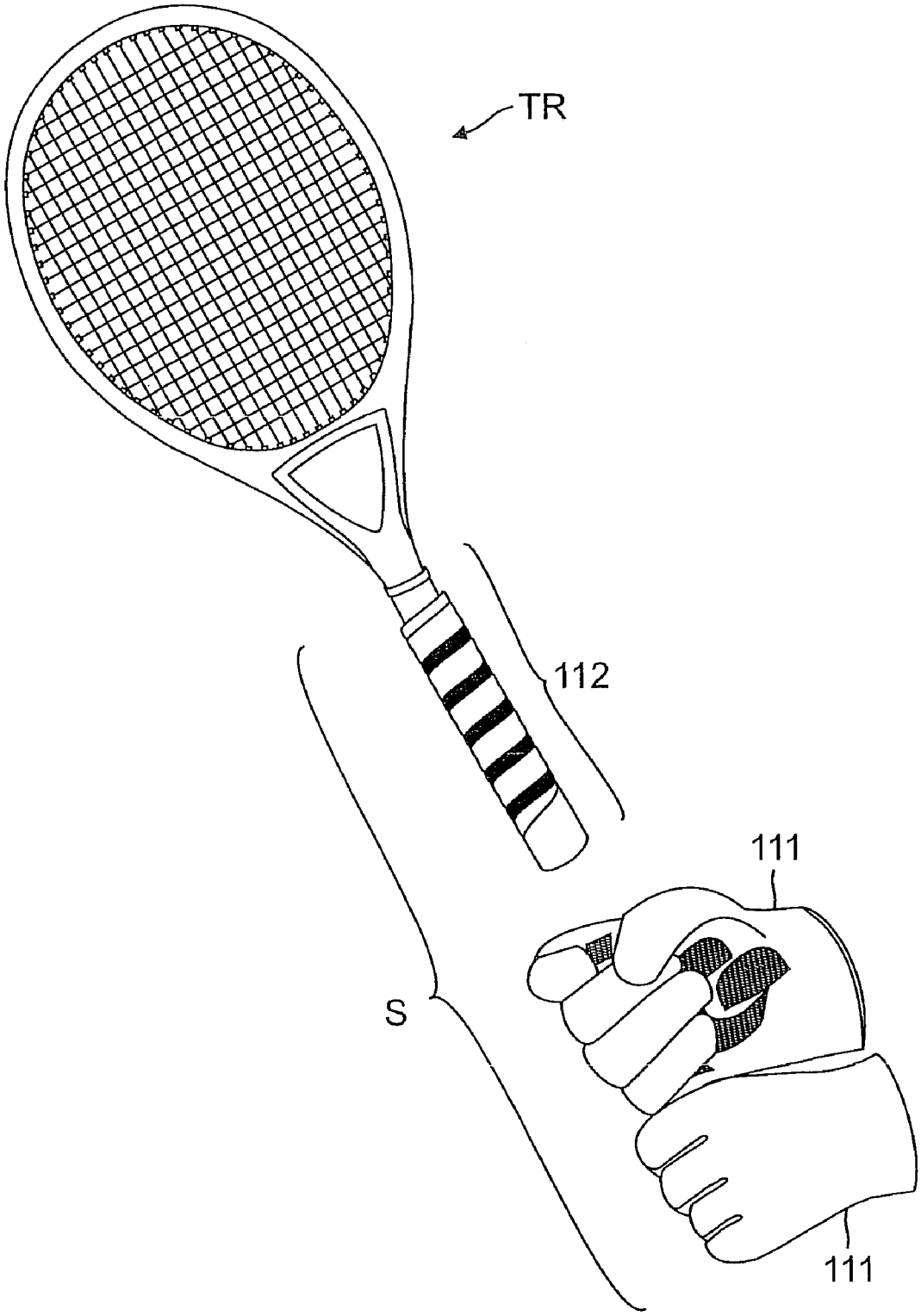
FIG. 8 is a perspective view and an exploded view of a glove-and-grip system as applied to a sporting good, such as a tennis racquet, comprising a grip, by example only, according to an embodiment of the present invention.

FIG. 8 illustrates a glove-and-grip system S as applied to a sporting good, such as a tennis racquet TR, comprising a grip 112, by example only, according to an embodiment of the present invention. The system S includes at least one glove 111, and at least one graspable surface, such as at least one grip 112, by example only. Both the glove 111 and the grip 112 are adapted to securely mate with each other. The glove 111 comprises a gripping feature. The glove 111 has a palm side, a dorsal side, and a plurality of finger compartments. The palm side comprises a planar surface which interfaces with the palm of a user. The dorsal side comprises a back surface of the glove 111 which interfaces with the back side of a user's hand. The plurality of finger compartments accommodates the user's fingers. The glove 111 may comprise any suitable material. The gripping feature of the glove 111 comprises a fastener, such as a hook-and-hoop material, e.g., Velcro®, disposed on the palm side of the glove 111. In some preferred embodiments where the glove 111 comprises loop material, the loop material will mate with the corresponding hook material of the grip 112. In preferred embodiments, wherein the glove 111 alternatively comprises the hook material, the hook material will mate with the corresponding loop material of the grip 112. For a tennis racquet TR, the user may have a pair of gloves 111 for use on both hands in performing a two-handed backhand stroke.

Figure 9:
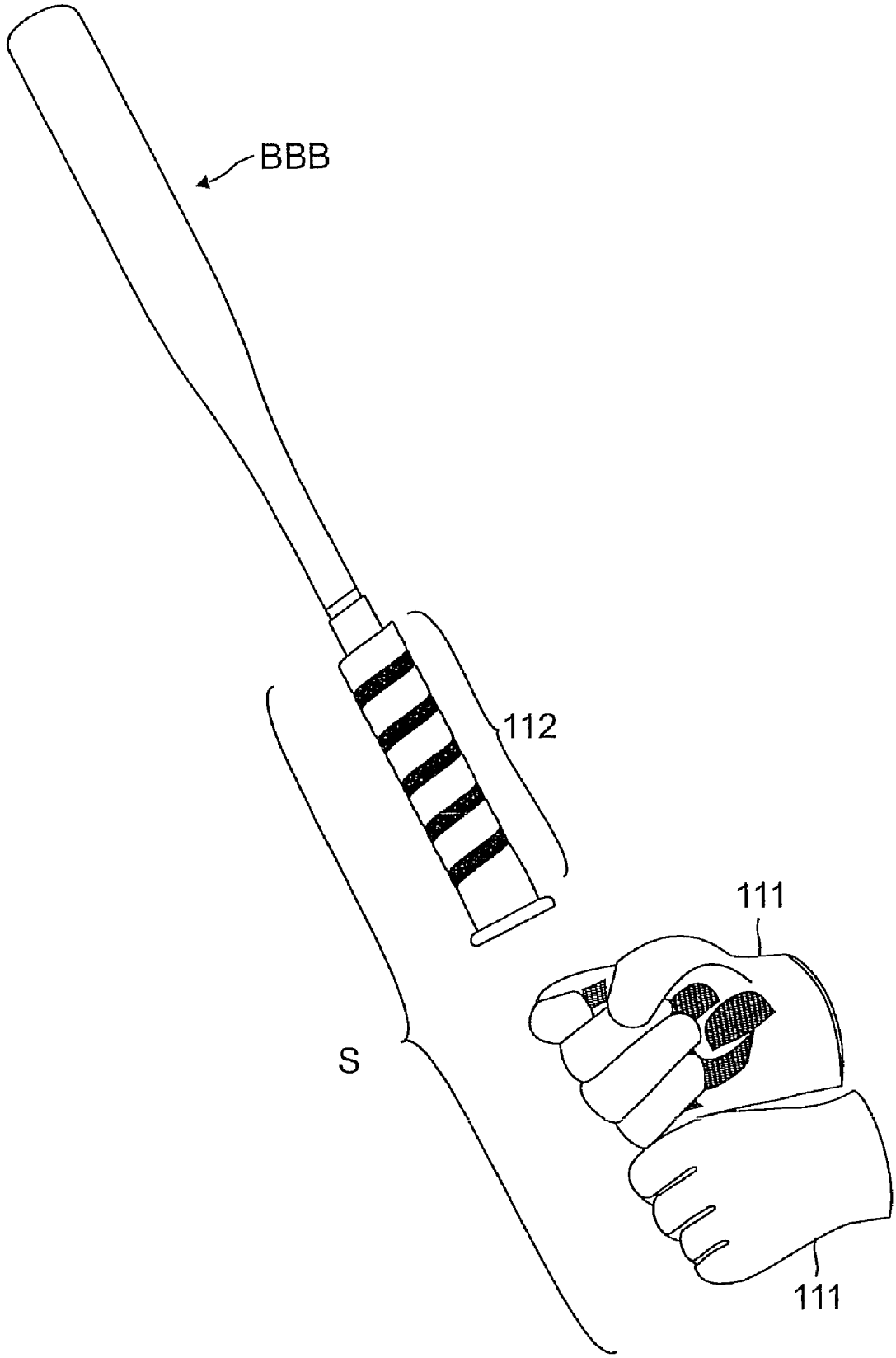
FIG. 9 is a perspective view of a glove-and-grip system as applied to a sporting good, such as a baseball bat, comprising a grip, by example only, according to an embodiment of the present invention.

FIG. 9 illustrates a glove-and-grip system S as applied to a sporting good, such as a baseball bat BBB, comprising a grip 112, by example only, according to an embodiment of the present invention. The system S includes at least one glove 111, and at least one graspable surface, such as at least one grip 112, by example only. Both the glove 111 and the grip 112 are adapted to securely mate with each other. The glove 111 comprises a gripping feature. The glove 111 has a palm side, a dorsal side, and a plurality of finger compartments. The palm side comprises a planar surface which interfaces with the palm of a user. The dorsal side comprises a back surface of the glove 111 which interfaces with the back side of a user's hand. The plurality of finger compartments accommodates the user's fingers. The glove 111 may comprise any suitable material. The gripping feature of the glove 111 comprises a fastener, such as a hook-and-hoop material, e.g., Velcro®, disposed on the palm side of the glove 111. In some preferred embodiments where the glove 111 comprises loop material, the loop material will mate with the corresponding hook material of the grip 112. In preferred embodiments, wherein the glove 111 alternatively comprises the hook material, the hook material will mate with the corresponding loop material of the grip 112. For a baseball bat BBB, the user will typically have a pair of gloves 111 for use on both hands in performing the batting stroke.

Figure 10:
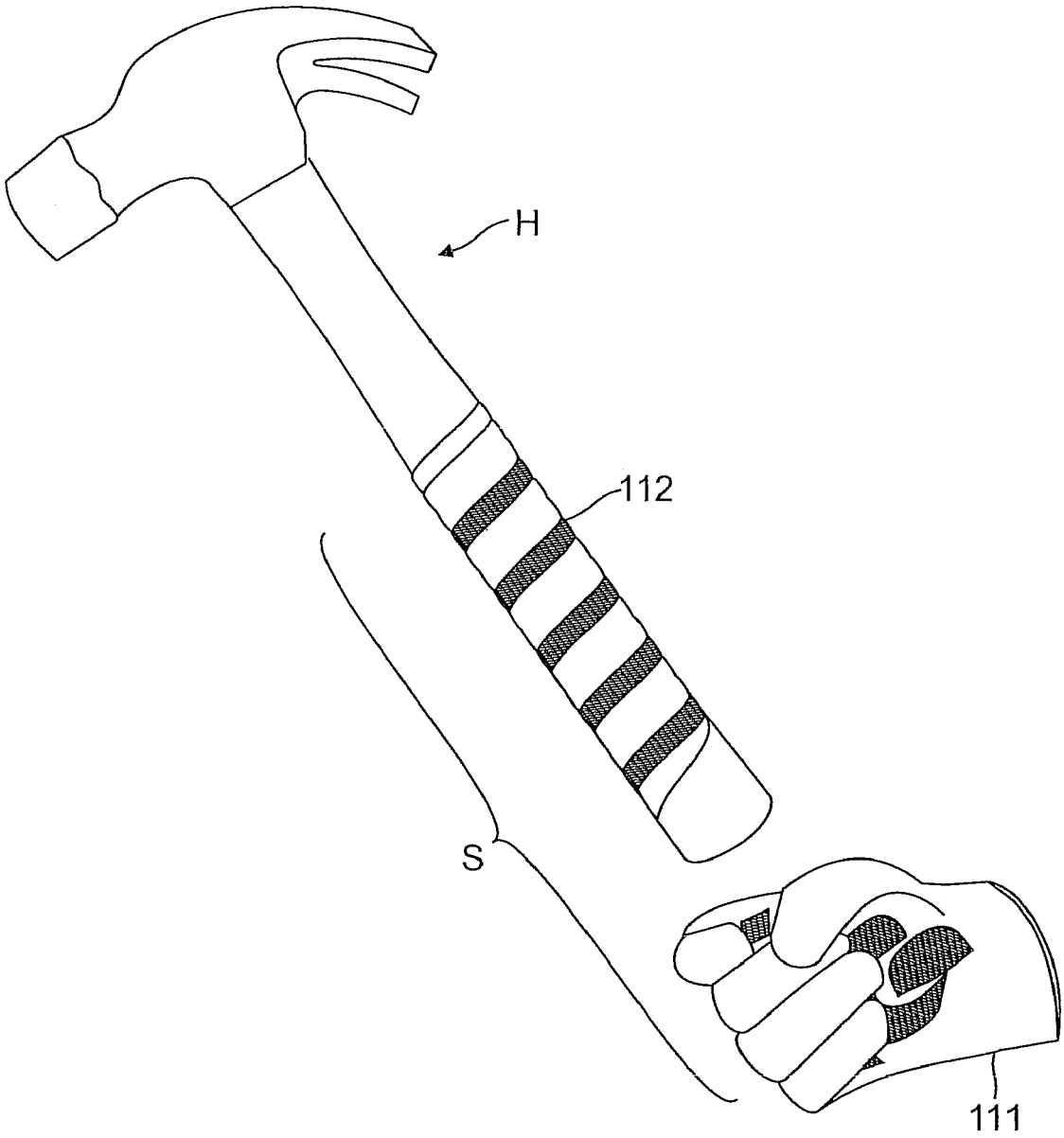
FIG. 10 is a perspective view of a glove-and-grip system as applied to a hardware tool, such as a hammer, comprising a grip, by example only, according to an embodiment of the present invention.

FIG. 10 illustrates a glove-and-grip system S as applied to a hardware tool, such as a hammer H, comprising a grip 112, by example only, according to an embodiment of the present invention. The system S includes at least one glove 111, and at least one graspable surface, such as at least one grip 112, by example only. Both the glove 111 and the grip 112 are adapted to securely mate with each other. The glove 111 comprises a gripping feature. The glove 111 has a palm side, a dorsal side, and a plurality of finger compartments. The palm side comprises a planar surface which interfaces with the palm of a user. The dorsal side comprises a back surface of the glove 111 which interfaces with the back side of a user's hand. The plurality of finger compartments accommodates the user's fingers. The glove 111 may comprise any suitable material. The gripping feature of the glove 111 comprises a fastener, such as a hook-and-hoop material, e.g., Velcro®, disposed on the palm side of the glove 111. In some preferred embodiments where the glove 111 comprises loop material, the loop material will mate with the corresponding hook material of the grip 112. In preferred embodiments, wherein the glove 111 alternatively comprises the hook material, the hook material will mate with the corresponding loop material of the grip 112. For a hammer H, the user will typically have a single glove 111 for use on one hand in performing the hammering stroke.

Figure 11:
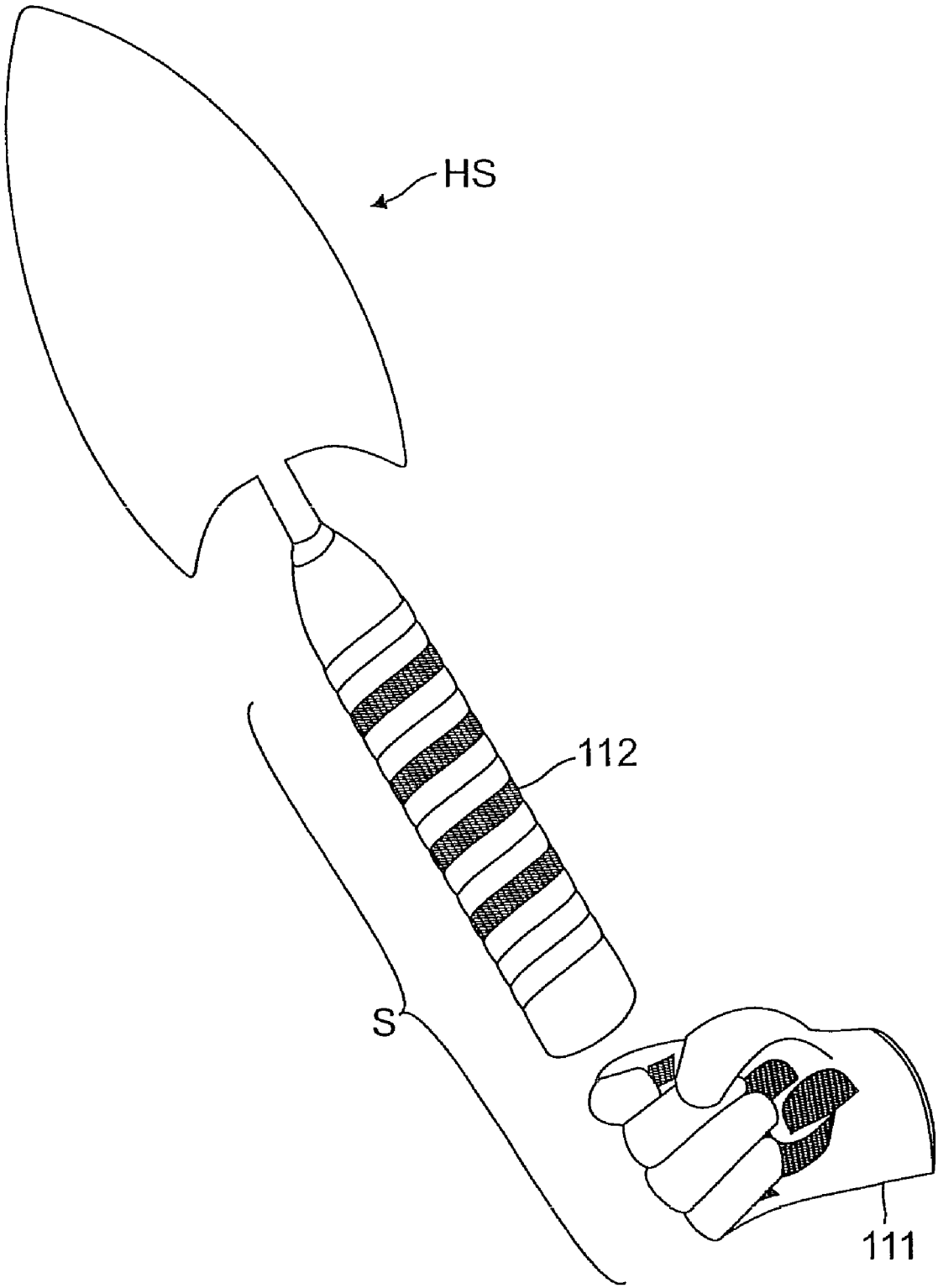
FIG. 11 is a perspective view of a glove-and-grip system as applied to a gardening tool, such as a hand spade, comprising a handle, by example only, according to an embodiment of the present invention.

FIG. 11 illustrates a glove-and-grip system S as applied to a gardening tool, such as a hand spade HS, comprising a handle or a grip 112, by example only, according to an embodiment of the present invention. The system S includes at least one glove 111, and at least one graspable surface, such as at least one grip 112, by example only. Both the glove 111 and the grip 112 are adapted to securely mate with each other. The glove 111 comprises a gripping feature. The glove 111 has a palm side, a dorsal side, and a plurality of finger compartments. The palm side comprises a planar surface which interfaces with the palm of a user. The dorsal side comprises a back surface of the glove 111 which interfaces with the back side of a user's hand. The plurality of finger compartments accommodates the user's fingers. The glove 111 may comprise any suitable material. The gripping feature of the glove 111 comprises a fastener, such as a hook-and-hoop material, e.g., Velcro®, disposed on the palm side of the glove 111. In some preferred embodiments where the glove 111 comprises loop material, the loop material will mate with the corresponding hook material of the grip 112. In preferred embodiments, wherein the glove 111 alternatively comprises the hook material, the hook material will mate with the corresponding loop material of the grip 112. For a hand spade HS, the user will typically have a single glove 111 for use on one hand in performing the spading stroke.

Figure 12:
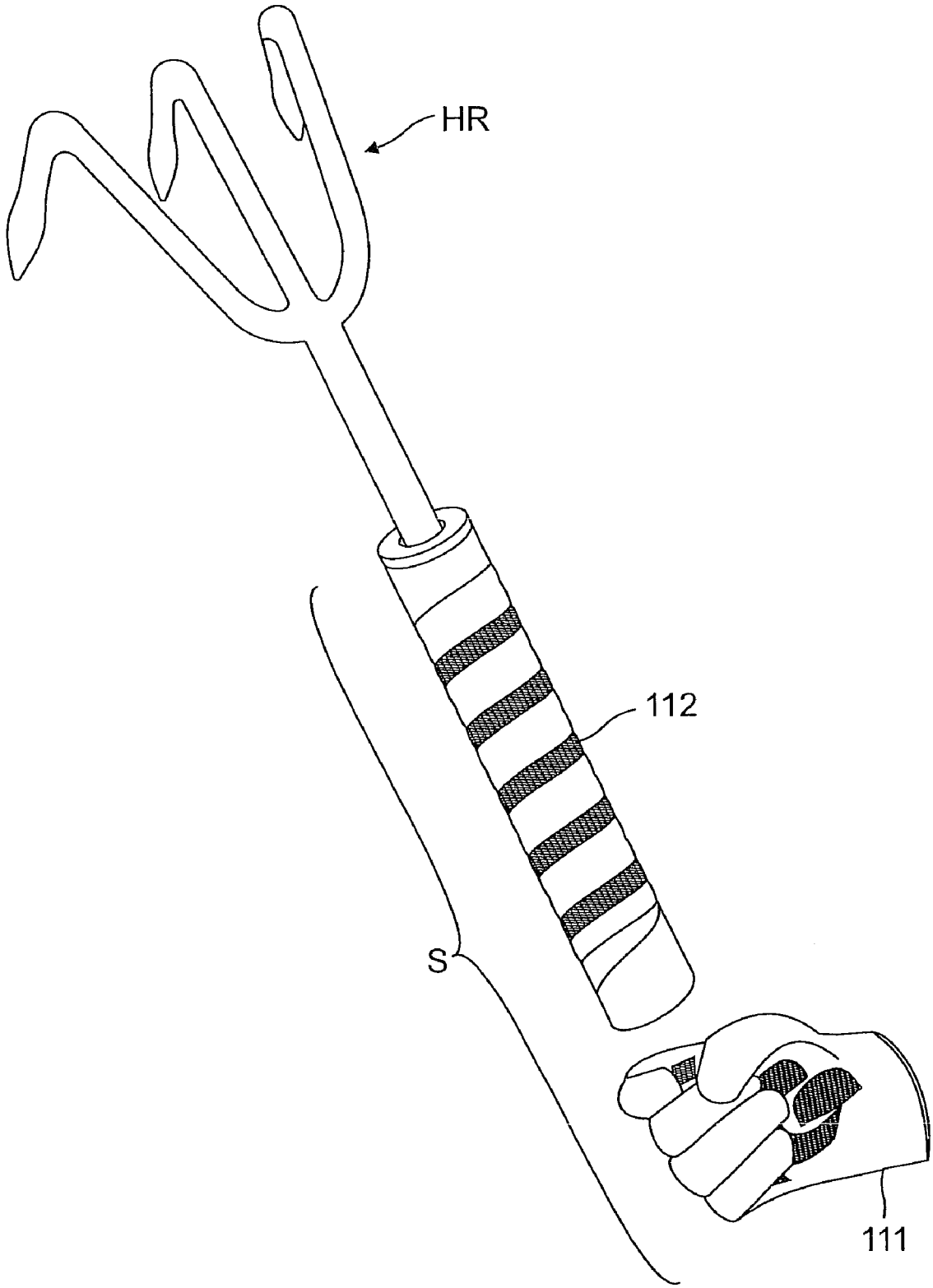
FIG. 12 is a perspective view of a glove-and-grip system as applied to a gardening tool, such as a hand rake, comprising a handle, by example only, according to an embodiment of the present invention.

FIG. 12 illustrates a glove-and-grip system S as applied to a gardening tool, such as a hand rake HR, comprising a handle or a grip 112, by example only, according to an embodiment of the present invention. The system S includes at least one glove 111, and at least one graspable surface, such as at least one grip 112, by example only. Both the glove 111 and the grip 112 are adapted to securely mate with each other. The glove 111 comprises a gripping feature. The glove 111 has a palm side, a dorsal side, and a plurality of finger compartments. The palm side comprises a planar surface which interfaces with the palm of a user. The dorsal side comprises a back surface of the glove 111 which interfaces with the back side of a user's hand. The plurality of finger compartments accommodates the user's fingers. The glove 111 may comprise any suitable material. The gripping feature of the glove 111 comprises a fastener, such as a hook-and-hoop material, e.g., Velcro®, disposed on the palm side of the glove 111. In some preferred embodiments where the glove 111 comprises loop material, the loop material will mate with the corresponding hook material of the grip 112. In preferred embodiments, wherein the glove 111 alternatively comprises the hook material, the hook material will mate with the corresponding loop material of the grip 112. For a hand rake HR, the user will typically have a single glove 111 for use on one hand in performing the raking stroke.

Figure 13:
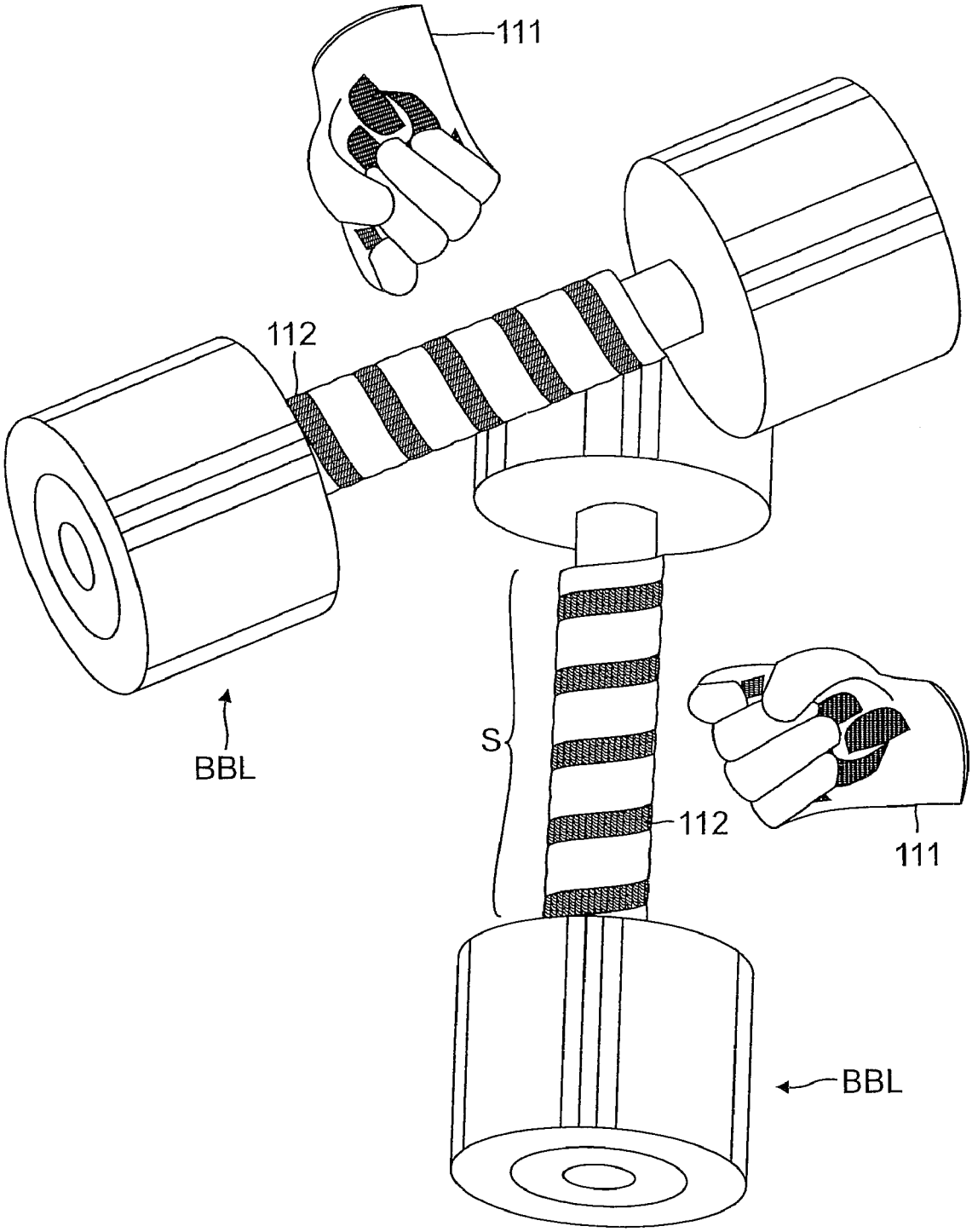
FIG. 13 is a perspective view of a glove-and-grip system as applied to exercise equipment, such as a barbell, comprising a grip, by example only, according to an embodiment of the present invention.

FIG. 13 illustrates a glove-and-grip system S as applied to exercise equipment, such as a barbell BBL, comprising a grip 112, by example only, according to an embodiment of the present invention. The system S includes at least one glove 111, and at least one graspable surface, such as at least one grip 112, by example only. Both the glove 111 and the grip 112 are adapted to securely mate with each other. The glove 111 comprises a gripping feature. The glove 111 has a palm side, a dorsal side, and a plurality of finger compartments. The palm side comprises a planar surface which interfaces with the palm of a user. The dorsal side comprises a back surface of the glove 111 which interfaces with the back side of a user's hand. The plurality of finger compartments accommodates the user's fingers. The glove 111 may comprise any suitable material. The gripping feature of the glove 111 comprises a fastener, such as a hook-and-hoop material, e.g., Velcro®, disposed on the palm side of the glove 111. In some preferred embodiments where the glove 111 comprises loop material, the loop material will mate with the corresponding hook material of the grip 112. In preferred embodiments, wherein the glove 111 alternatively comprises the hook material, the hook material will mate with the corresponding loop material of the grip 112. For a barbell BBL, the user may have a pair of gloves 111 for use on both hands in performing a curl stroke, for instance.

Figure 14:
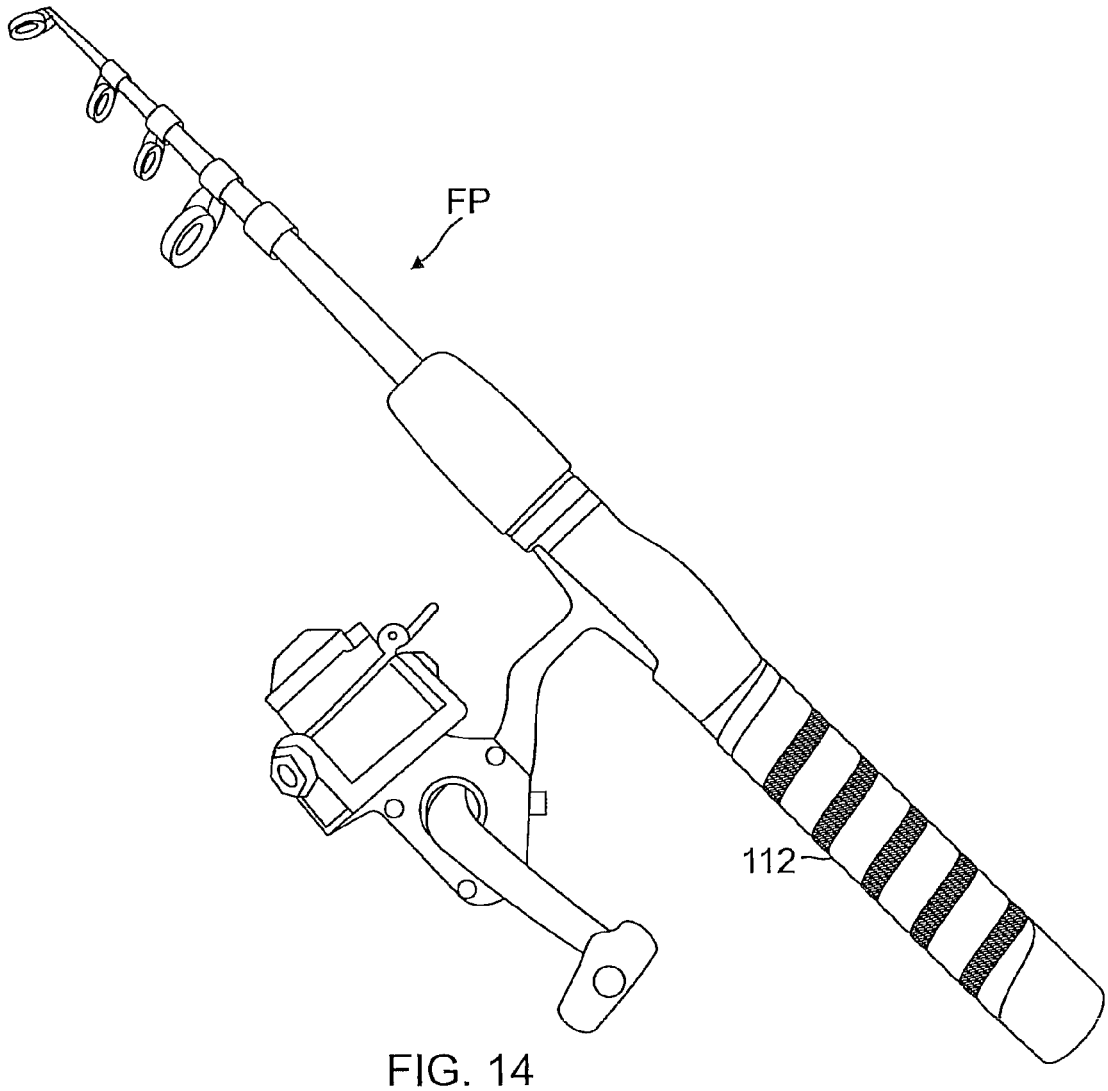
FIG. 14 is a perspective view of a glove-and-grip system as applied to a fishing pole, comprising a handle, by example only, according to an embodiment of the present invention.

FIG. 14 illustrates a glove-and-grip system S as analogously shown in FIG. 12 as applied to a fishing pole FP comprising a handle 112, by example only, according to an embodiment of the present invention. The system S includes at least one glove 111 as analogously shown in FIG. 12, and at least one graspable surface, such as at least one grip 112, by example only. Both the glove 111 and the grip 112 are adapted to securely mate with each other. The glove 111 comprises a gripping feature. The glove 111 has a palm side, a dorsal side, and a plurality of finger compartments. The palm side comprises a planar surface which interfaces with the palm of a user. The dorsal side comprises a back surface of the glove 111 which interfaces with the back side of a user's hand. The plurality of finger compartments accommodates the user's fingers. The glove 111 may comprise any suitable material. The gripping feature of the glove 111 comprises a fastener, such as a hook-and-hoop material, e.g., Velcro®, disposed on the palm side of the glove 111. In some preferred embodiments where the glove 111 comprises loop material, the loop material will mate with the corresponding hook material of the grip 112. In preferred embodiments, wherein the glove 111 alternatively comprises the hook material, the hook material will mate with the corresponding loop material of the grip 112. For a fishing pole FP, the user may have a pair of gloves 111 for use on both hands in casting and maintaining the fishing pole FP, for instance.

Figure 15:
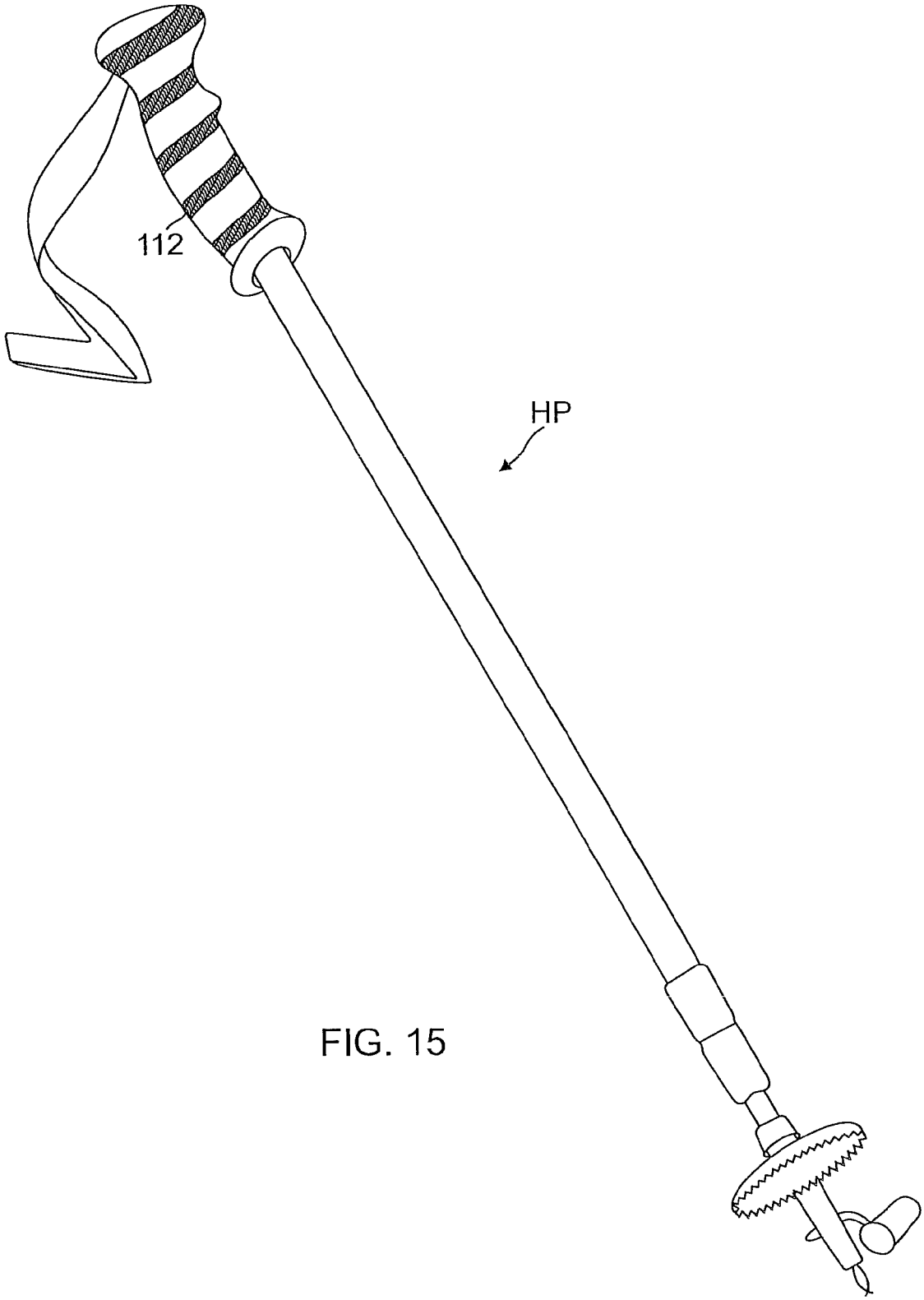
FIG. 15 is a perspective view of a glove-and-grip system as applied to a hiking pole, comprising a handle, by example only, according to an embodiment of the present invention.

FIG. 15 illustrates a glove-and-grip system S as analogously shown in FIG. 12 as applied to a hiking pole BP, comprising a handle 112, by example only, according to an embodiment of the present invention. The system S includes at least one glove 111 as analogously shown in FIG. 12, and at least one graspable surface, such as at least one grip 112, by example only. Both the glove 111 and the grip 112 are adapted to securely mate with each other. The glove 111 comprises a gripping feature. The glove 111 has a palm side, a dorsal side, and a plurality of finger compartments. The palm side comprises a planar surface which interfaces with the palm of a user. The dorsal side comprises a back surface of the glove 111 which interfaces with the back side of a user's hand. The plurality of finger compartments accommodates the user's fingers. The glove 111 may comprise any suitable material. The gripping feature of the glove 111 comprises a fastener, such as a hook-and-hoop material, e.g., Velcro®, disposed on the palm side of the glove 111. In some preferred embodiments where the glove 111 comprises loop material, the loop material will mate with the corresponding hook material of the grip 112. In preferred embodiments, wherein the glove 111 alternatively comprises the hook material, the hook material will mate with the corresponding loop material of the grip 112.

Figure 16:
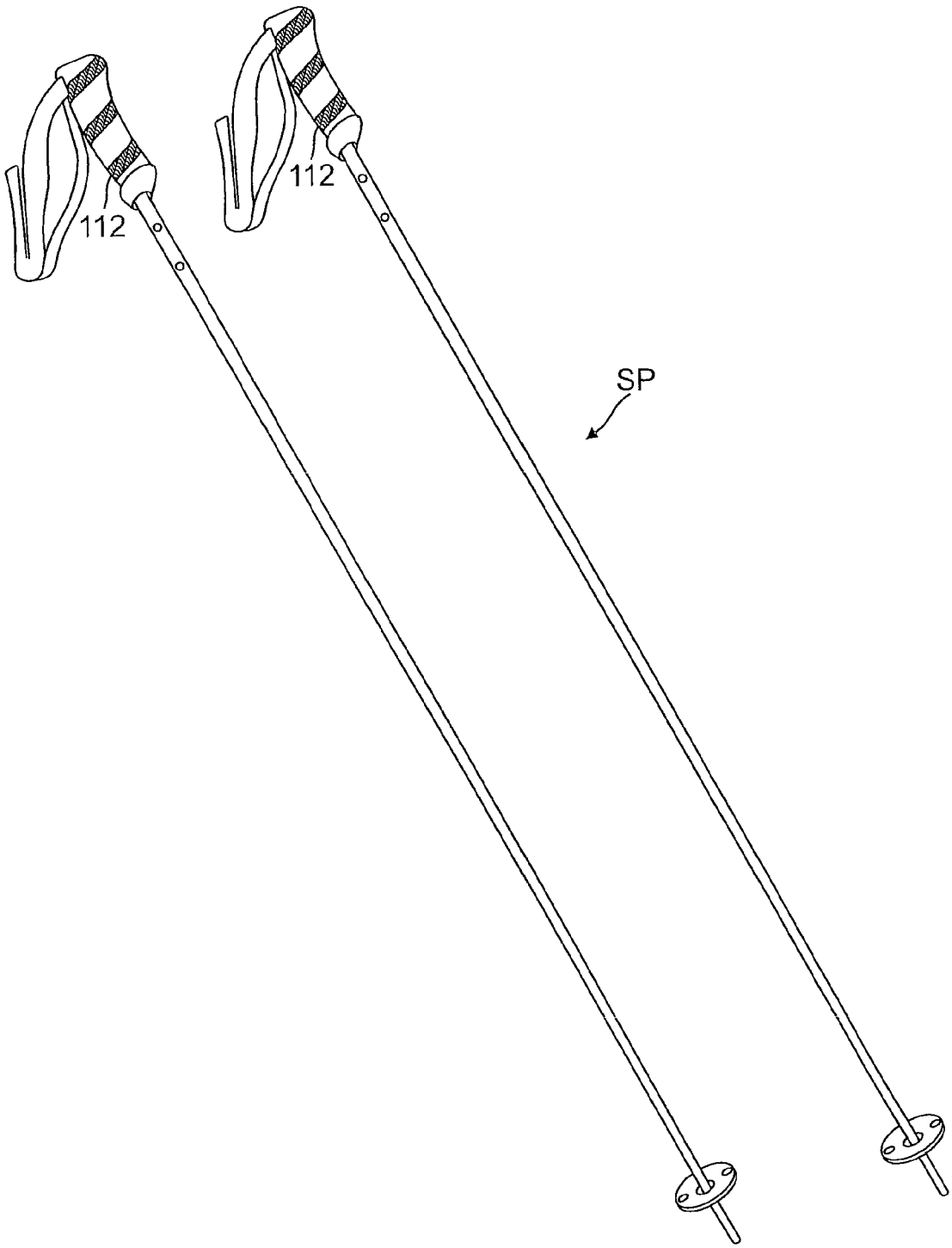
FIG. 16 is a perspective view of a glove-and-grip system as applied to a ski pole, comprising a handle, by example only, according to an embodiment of the present invention.

FIG. 16 illustrates a glove-and-grip system S as analogously shown in FIG. 12 as applied to a ski pole SP, comprising a handle 112, by example only, according to an embodiment of the present invention. The system S includes at least one glove 111 as analogously shown in FIG. 12, and at least one graspable surface, such as at least one grip 112, by example only. Both the glove 111 and the grip 112 are adapted to securely mate with each other. The glove 111 comprises a gripping feature. The glove 111 has a palm side, a dorsal side, and a plurality of finger compartments. The palm side comprises a planar surface which interfaces with the palm of a user. The dorsal side comprises a back surface of the glove 111 which interfaces with the back side of a user's hand. The plurality of finger compartments accommodates the user's fingers. The glove 111 may comprise any suitable material. The gripping feature of the glove 111 comprises a fastener, such as a hook-and-hoop material, e.g., Velcro®, disposed on the palm side of the glove 111. In some preferred embodiments where the glove 111 comprises loop material, the loop material will mate with the corresponding hook material of the grip 112. In preferred embodiments, wherein the glove 111 alternatively comprises the hook material, the hook material will mate with the corresponding loop material of the grip 112.

Figure 17:
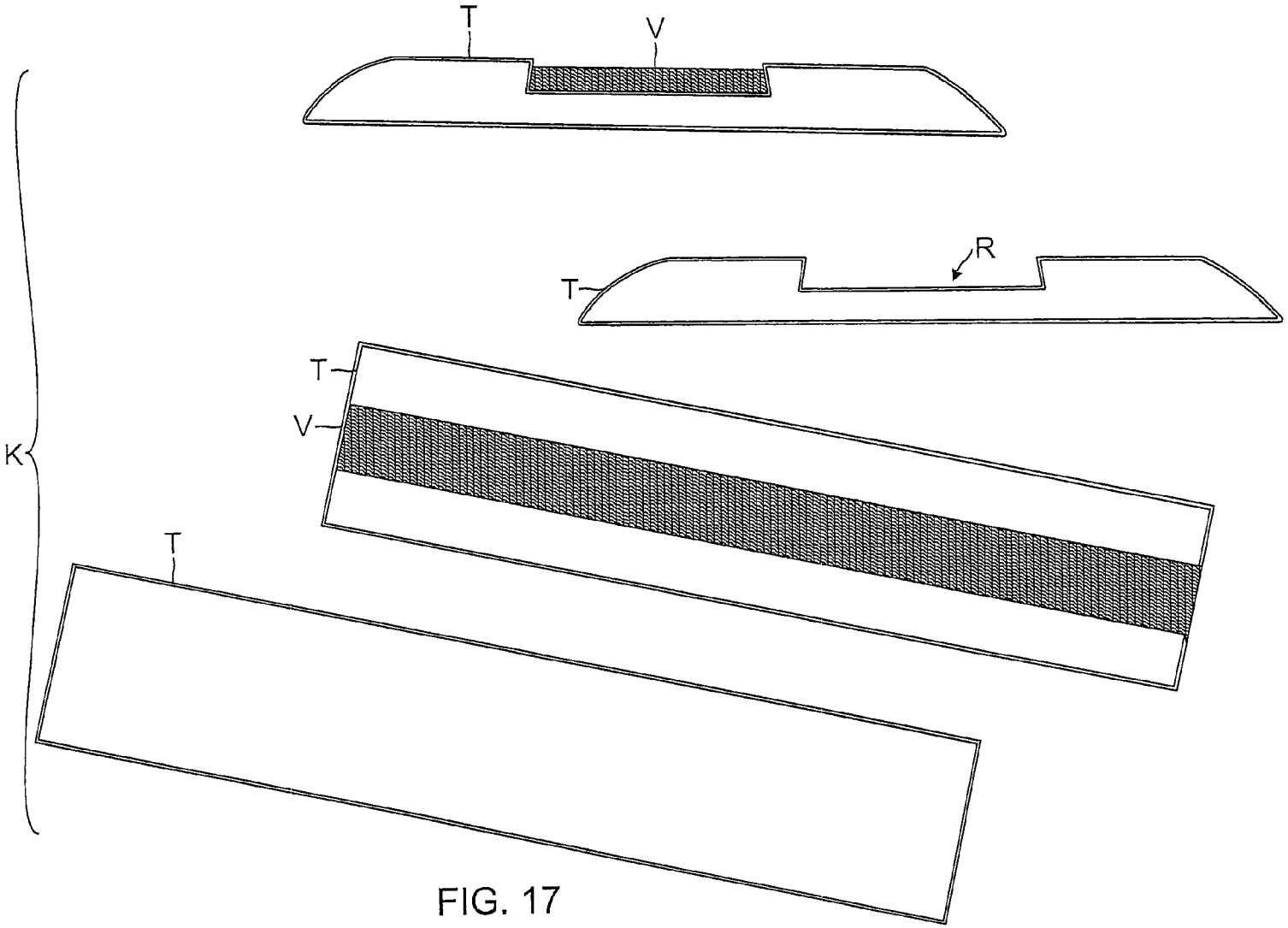
FIG. 17 is a perspective view of a retrofit-tape kit for retrofitting a glove-and-grip system as applied to any object, comprising a graspable surface, such as a grip or a handle, by example only, according to an embodiment of the present invention.

FIG. 17 illustrates a retrofit-tape kit K for retrofitting a glove-and-grip system S as analogously shown in FIG. 8 as applied to any object (not shown), comprising a graspable surface (not shown), such as a grip (not shown) or a handle (not shown), by example only, according to an embodiment of the present invention. The retrofit kit K comprises a length retrofit tape T having recesses R which are used to accommodate the hook material or the loop material V for flush disposition with the surface of a graspable surface (not shown). The length of tape T may be provided in a roll-form. The purpose of the recesses R is to obscure the view of the hook material or the loop material on the graspable surface. The primary reason for obscuring the view of the hook material or the loop material is to alleviate any insecurity or conflicting emotions of a user when using an object in the presence of others. Another reason is that the recesses may be more comfortable to the touch for some users. The use of recesses is preferred, but not specifically required by the present invention. In other words, some embodiments may incorporate the recesses; and other embodiments may not.

Figure 18:
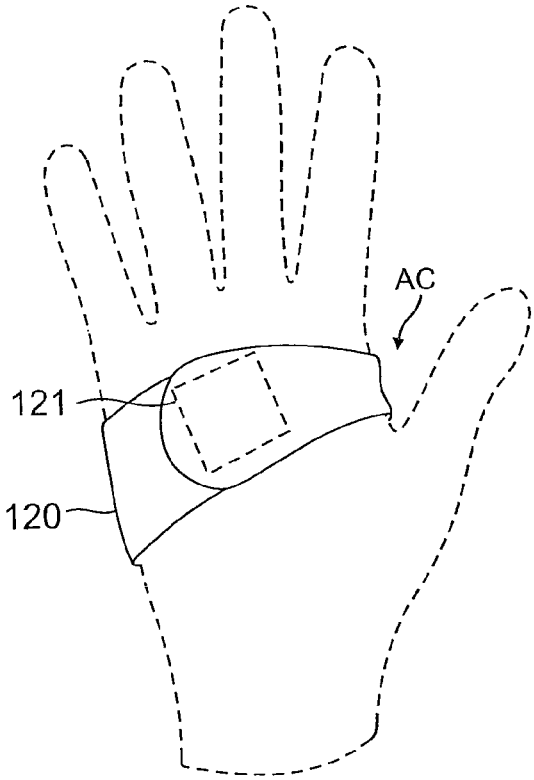
FIG. 18 is a dorsal side view of an adaptive cuff, having a cuff fastener, the cuff fastener including a hook-and-loop fastener material, by example only, according to an embodiment of the present invention.

FIG. 18 illustrates, in a dorsal side view, an adaptive cuff AC, comprising a cuff portion 120, a cuff fastener 121, and a fastener region 122 (not shown), wherein the cuff fastener 121 including a hook-and-loop fastener material 123, by example only, according to an embodiment of the present invention. The cuff portion 120 is wrapped around a user's hand and fastened on the dorsal side of the hand via the cuff fastener 121.

Figure 19:
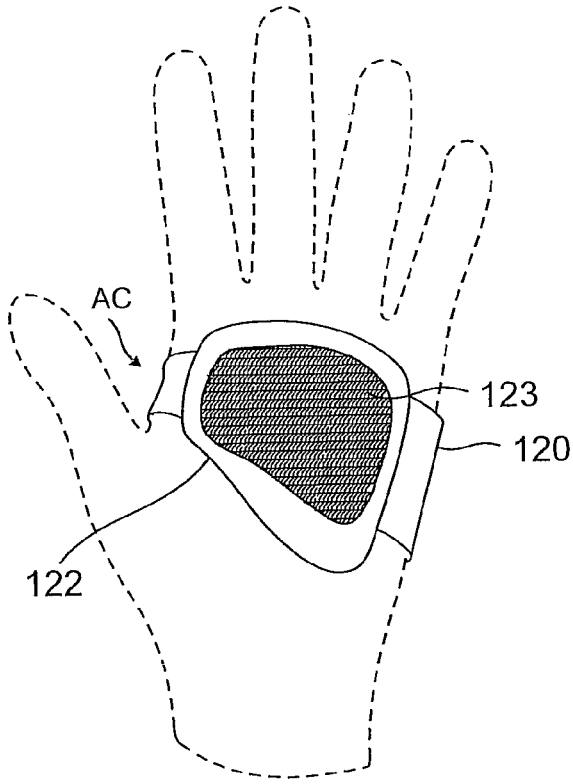
FIG. 19 is a palm side view of an adaptive cuff, having a fastener region, the fastener region including a hook-and-loop fastener material, by example only, according to an embodiment of the present invention.

FIG. 19 illustrates, in a palm side view, an adaptive cuff AC, comprising a cuff portion 120, a cuff fastener 121 (not shown), and a fastener region 122, wherein the cuff fastener 121 including a hook-and-loop fastener material 123, by example only, according to an embodiment of the present invention. The fastener region 122 is disposed on the palm side of a user's hand for facilitating gripping a graspable surface having a complementary hook-and-loop material.

Figure 20:
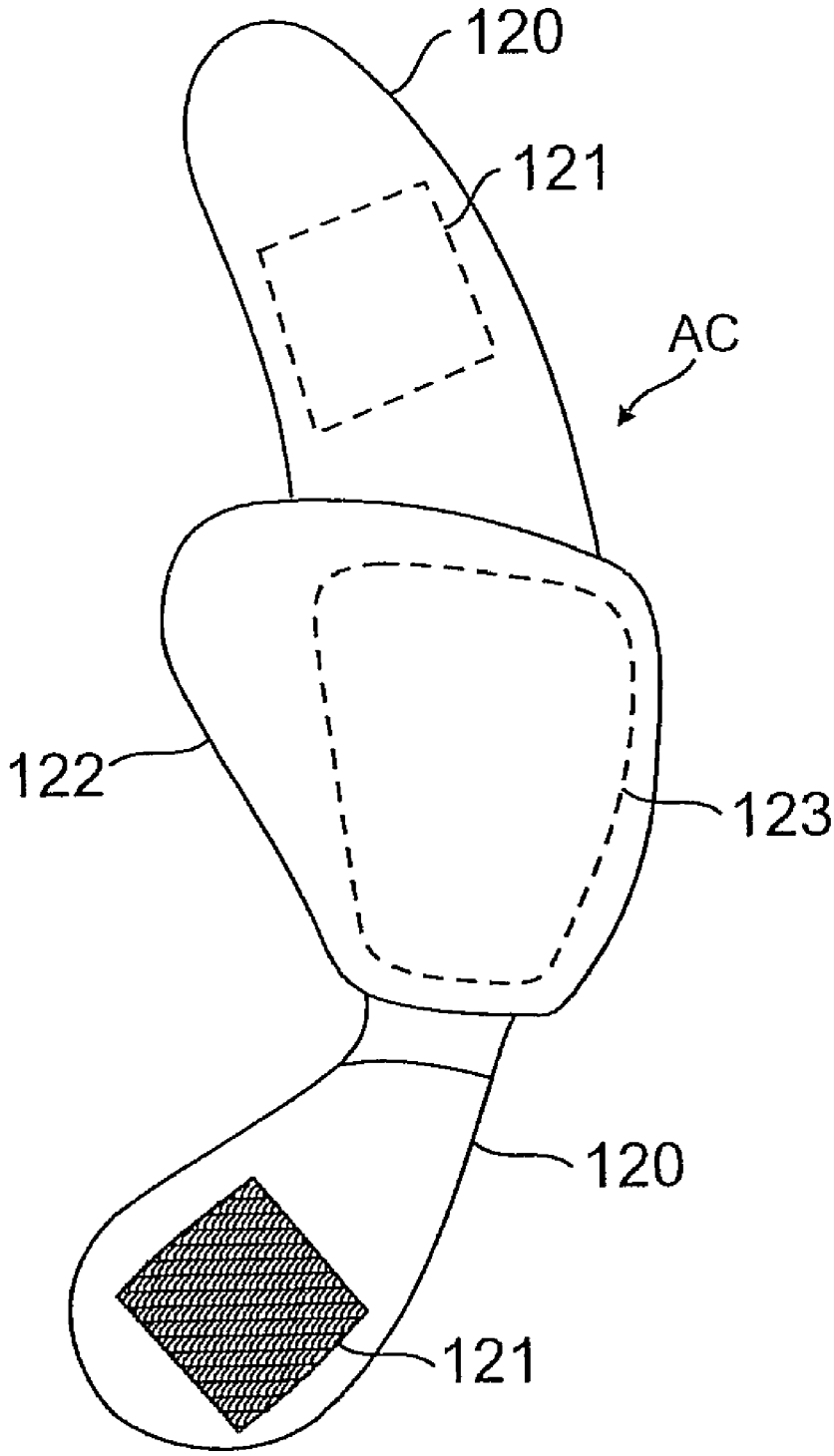
FIG. 20 is an interior side view of an adaptive cuff, having a fastener region, the fastener region including a hook-and-loop fastener material, by example only, according to an embodiment of the present invention.

FIG. 20 illustrates, in an interior side view, an adaptive cuff AC, comprising a cuff portion 120, a cuff fastener 121, and a fastener region 122, wherein the cuff fastener 121 including a hook-and-loop fastener material 123, by example only, according to an embodiment of the present invention.

Information as herein shown and described in detail is fully capable of attaining the above-described object of the invention, the presently preferred embodiment of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more." All structural and functional equivalents to the elements of the above-described preferred embodiment and additional embodiments that are known to those of ordinary skill in the art are hereby expressly incorporated by reference and are intended to be encompassed by the present claims.

Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. However, that various changes and modifications in form, material, and fabrication material detail may be made, without departing from the spirit and scope of the invention as set forth in the appended claims, should be readily apparent to those of ordinary skill in the art. No claim herein is to be construed under the provisions of 35 U.S.C. §112, sixth paragraph, unless the element is expressly recited using the phrase "means for."

INDUSTRIAL APPLICABILITY

The present invention industrially applies to systems, apparatuses, and methods for assisting persons having weakened hand-strength with the grasp and retention of an object. More particularly, the present invention industrially applies to systems, apparatuses, and methods for assisting persons having weakened hand-strength with the grasp and retention of a graspable surface for any given object.

What is claimed is:

1. A glove-and-grip system, comprising: at least one glove; and at least one grip, the at least one glove for accommodating at least one user's hand and for interfacing and mating with the at least one grip, and the at least one grip comprising a graspable surface of an object, the at least one glove comprising a palm side, a dorsal side, and a plurality of finger compartments, the at least one glove further comprising a hook-and-loop fastener material, the at least one grip comprising a top side, a bottom side, an upper half, a lower half, and at least one recess, the at least one grip further comprising a complementary hook-and-loop fastener material flushly disposed in the at least one recess, and the at least one glove hook-and-loop fastener material being attachable and detachable in relation to the grip complementary hook-and-loop fastener material in a discreet visually obscured manner.

2. The system, as recited in claim 1, wherein the at least one recess comprises a spiraling configuration, and wherein the complementary hook-and-loop fastener material is flushly disposed in the at least one recess in the spiraling configuration.

3. The system, as recited in claim 1, wherein the hook-and-loop fastener material is integrated into at least one element selected from a group consisting essentially of the plurality of finger compartments and the palm side.

4. The system, as recited in claim 1, wherein the at least one grip comprises rubber.

5. The system, as recited in claim 1, wherein the complementary hook-and-loop fastener material extends through at least one location selected from a group consisting essentially of the grip upper half and the grip lower half.

6. The system, as recited in claim 1, wherein the at least one recess comprises a spiraling configuration, wherein the complementary hook-and-loop fastener material is flushly disposed in the at least one recess in the spiraling configuration, wherein the hook-and-loop fastener material is integrated into at least one element selected from a group consisting essentially of the plurality of finger compartments and the palm side, and wherein the complementary hook-and-loop fastener material extends through at least one location selected from a group consisting essentially of the grip upper half and the grip lower half.

7. The system, as recited in claim 1, wherein the hook-and-loop fastener material is integrated into the plurality of finger compartments for facilitating training at least one grip associated with at least one element selected from a group consisting essentially of a sporting good, a tennis racquet, a racquetball racquet, a squash racquet, a Jai alai cesta, a fencing weapon, 5 a miniature golf club, a croquet mallet, a cricket bat, a softball bat, a baseball bat, exercise equipment, a barbell, a piece of gymnasium equipment, a piece of physical therapy equipment, a hardware tool, a hammer, a screwdriver, a saw, a power tool, a power drill, an electric screwdriver, a kitchen tool, a knife, a spatula, a kitchen utensil, a piece of flatware, a cooking apparatus, a pot, a pan, a biomedical device, a prosthetic, a disability tool, a walking-assistance apparatus, a cane, a walking stick, a walker, a recreational good, a hiking pole, a wind-sailing grip, a hang-gliding grip, a kayak paddle, a canoe paddle, a fishing pole, a fishing net pole, a ski pole, a gardening tool, a hand-rake, a hand spade, a hand shovel, a toothbrush, a manual toothbrush, an electric toothbrush, and any object having a graspable surface.

8. The system, as recited in claim 1, wherein the at least one glove comprises at least one element selected from a group consisting essentially of a fingered glove, a fingerless glove, a mitten, and an adaptive cuff.

9. A retrofit-tape apparatus, comprising: a retrofit-tape, the retrofit-tape being adaptable to any graspable surface of any object, and the retrofit-tape comprising a hook-and-loop fastener material.

10. An apparatus, as recited in claim 9, further comprising at least one end-stop for retaining the retrofit-tape in a desired position in relation to a user's hand.

11. A method of fabricating a glove-and-grip system, comprising:

making at least one glove comprising a palm side, a dorsal side, and a plurality of finger compartments;

affixing a hook and loop fastener material to the at least one glove;

making at least one grip comprising a top side, a bottom side, an upper half, a lower half, and at least one recess; and disposing, flushly, a complementary hook-and-loop fastener material in the at least one recess, wherein the at least one glove is adapted for accommodating at least one user's hand and for interfacing and mating with the at least one grip, the at least one grip comprising a graspable surface of an object, and the at least one glove hook-and-loop fastener material being attachable and detachable in relation to the grip complementary hook-and-loop fastener material in a discreet visually obscured manner.

12. The method, as recited in claim 11, wherein the at least one recess comprises a spiraling configuration, and the disposing of the complementary hook-and-loop fastener material comprises flushly disposing the complementary hook-and-loop fastener material in the at least one recess in the spiraling configuration.

13. The method, as recited in claim 11, further comprising integrating hook-and-loop fastener material into at least one element selected from a group consisting essentially of the plurality of finger compartments and the palm side.

14. The method, as recited in claim 11, wherein the at least one grip comprises rubber.

15. The method, as recited in claim 11, wherein the complementary hook-and-loop fastener material extends through at least one location selected from a group consisting essentially of the grip upper half and the grip lower half.

16. The method, as recited in claim 11, wherein the at least one recess comprises a spiraling configuration, the disposing of the complementary hook-and-loop fastener material comprises disposing the complementary hook-and-loop fastener in the at least one recess in the spiraling configuration, the hook-and-loop fastener material is integrated into at least one element selected from a group consisting essentially of the plurality of finger compartments and the palm side, and the complementary hook-and-loop fastener material extends through at least one location selected from a group consisting essentially of the grip upper half and the grip lower half.

17. The method, as recited in claim 11, further comprising integrating the hook-and-loop fastener material into the plurality of finger compartments for facilitating training at least one grip associated with at least one element selected from a group consisting essentially of a sporting good, a tennis racquet, a racquetball racquet, a squash racquet, a Jai alai cesta, a fencing weapon, a miniature golf club, a croquet mallet, a cricket bat, a softball, a baseball bat, exercise equipment, a barbell, a piece of gymnasium equipment, a piece of physical therapy equipment, a hardware tool, a hammer, a screwdriver, a saw, a power tool, a power drill, an electric screwdriver, a kitchen tool, a knife, a spatula, a kitchen utensil, a piece of flatware, a cooking apparatus, a pot, a pan, a biomedical device, a prosthetic, a disability tool, a walking-assistance apparatus, a cane, a walking stick, a walker, a recreational good, a hiking pole, a wind-sailing grip, a hang-gliding grip, a kayak paddle, a canoe paddle, a fishing pole, a fishing net pole, a ski pole, a gardening tool, a hand-rake, a hand spade, a hand shovel, a toothbrush, a manual toothbrush, an electric toothbrush, and any object having a graspable surface.

18. The method, as recited in claim 11, wherein the at least one glove comprises at least one element selected from a group consisting essentially of a fingered glove, a fingerless glove, a mitten, and an adaptive cuff.

19. A method of using a grip system, comprising:

putting on at least one glove comprising a palm side, a dorsal side, a plurality of finger compartments, and a hook-and-loop fastener material, wherein the at least one glove is adapted for accommodating at least one user's hand and for interfacing and mating with at least one grip;

placing the at least one glove on the at least one grip by attaching the at least one glove hook-and-loop fastener material to the at least one grip complementary hook-and-loop fastener material;

wherein the at least one grip comprises a graspable surface of an object, and comprises a top side, a bottom side, an upper half, a lower half, at least one recess, and a complementary hook-and-loop fastener material is flushly disposed in the at least one recess, and the at least one glove hook-and-loop fastener material being attachable and detachable in relation to the grip complementary hook-and-loop fastener material in a discreet visually obscured manner.

20. The method, as recited in claim 19, wherein the at least one recess comprises a spiraling configuration, and wherein the complementary hook-and-loop fastener material is flushly disposed in the at least one recess in the spiraling configuration.

21. The method, as recited in claim 19, the hook-and-loop fastener material is integrated into at least one element selected from a group consisting essentially of the plurality of finger compartments and the palm side.

22. The method, as recited in claim 19, the at least one grip comprises rubber.

23. The method, as recited in claim 19, wherein the complementary hook-and-loop fastener material extends through at least one location selected from a group consisting essentially of the grip upper half and the grip lower half.

24. The method, as recited in claim 19, wherein the at least one recess comprises a spiraling configuration, the complementary hook-and-loop fastener material is disposed in the at least one recess in the spiraling configuration, and the hook-and-loop fastener material is integrated into at least one element selected from a group consisting essentially of the plurality of finger compartments and the palm side, and wherein the complementary hook-and-loop fastener material extends through at least one location selected from a group consisting essentially of the grip upper half and the grip lower half.

25. The method, as recited in claim 19, the hook-and-loop fastener material is integrated into the plurality of finger compartments for facilitating training at least one grip associated with at least one element selected from a group consisting essentially of a sporting good, a tennis racquet, a racquetball 5 racquet, a squash racquet, a Jai alai cesta, a fencing weapon, a miniature golf club, a croquet mallet, a cricket bat, a softball bat, a baseball bat, exercise equipment, a barbell, a piece of gymnasium equipment, a piece of physical therapy equipment, a hardware tool, a hammer, a screwdriver, a saw, a power tool, a power drill, an electric screwdriver, a kitchen tool, a knife, a spatula, a kitchen utensil, a piece of flatware, a cooking apparatus, a pot, a pan, a biomedical device, a prosthetic, a disability tool, a walking-assistance apparatus, a cane, a walking stick, a walker, a recreational good, a hiking pole, a wind-sailing grip, a hang-gliding grip, a kayak (paddle, a canoe paddle, a fishing pole, a fishing net pole, a ski pole, a gardening tool, a hand-rake, a hand spade, a hand shovel, a toothbrush, a manual toothbrush, an electric toothbrush, and any object having a graspable surface.

26. The method, as recited in claim 19, wherein the at least one user's hand comprises a condition selected from a group consisting essentially of a weakened hand strength, an insufficient hand-grip strength, a partial amputation, an able hand strength, and an environmentally compromised hand-grip strength.

27. The method, as recited in claim 19, wherein the at least one glove comprises at least one element selected from a group consisting essentially of a fingered glove, a fingerless glove, a mitten, and an adaptive cuff.

* * * * *

UNITED STATES PATENT AND TRADEMARK OFFICE

CERTIFICATE OF CORRECTION

PATENT NO. : 8,192,296 B2
APPLICATION NO. : 12/571097
DATED : June 5, 2012
INVENTOR(S) : Patrick Pinkart It is certified that error appears in the above-identified patent and that said Letters Patent is hereby corrected as shown below:

Claim 7, column 12, line 34, after “weapon,” delete “5”.
Claim 25, column 14, line 58, after “racquetball” delete “5”.
Claim 25, column 15, line 2, delete “(paddle,” and insert --paddle,--.

Signed and Sealed this
Eighteenth Day of September, 2012

David J. Kappos

David J. Kappos
*Director of the United States Patent and Trademark Office*